US012442190B2

(12) United States Patent
Mohand Kaci et al.

(10) Patent No.: US 12,442,190 B2
(45) Date of Patent: Oct. 14, 2025

(54) ROOFING MATERIALS HAVING A WATER CHANNEL AND AN ATTACHMENT TAB AND METHODS OF MAKING AND INSTALLING THEREOF

(71) Applicant: BMIC LLC, Dallas, TX (US)

(72) Inventors: Soufiane Mohand Kaci, Lincoln Park, NJ (US); Kevin Peter McGrath, Denville, NJ (US); Eric R. Anderson, Montclair, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 18/948,975

(22) Filed: Nov. 15, 2024

(65) Prior Publication Data

US 2025/0163701 A1 May 22, 2025

Related U.S. Application Data

(60) Provisional application No. 63/600,356, filed on Nov. 17, 2023.

(51) Int. Cl.

| | |
|---|---|
| ***E04D 1/34*** | (2006.01) |
| ***E04D 1/00*** | (2006.01) |
| *E04D 1/02* | (2006.01) |
| *E04D 1/22* | (2006.01) |

(52) U.S. Cl.

CPC ..... *E04D 1/34* (2013.01); *E04D 1/2916* (2019.08); *E04D 1/2949* (2019.08); *E04D 1/02* (2013.01); *E04D 1/22* (2013.01); *E04D 2001/3447* (2013.01); *E04D 2001/3458* (2013.01); *E04D 2001/3464* (2013.01)

(58) Field of Classification Search

CPC ..... E04D 1/2949; E04D 1/2916; E04D 2001/3464

See application file for complete search history.

(56) References Cited

U.S. PATENT DOCUMENTS

| | | | | |
|---|---|---|---|---|
| 1,434,166 | A * | 10/1922 | Thompson | E04D 1/2928 52/534 |
| 1,876,597 | A | 9/1932 | Bennett | |
| 2,482,835 | A * | 9/1949 | Bremer | E04D 1/2949 52/553 |
| 2,811,118 | A * | 10/1957 | Ball | E04D 1/2949 52/553 |

(Continued)

FOREIGN PATENT DOCUMENTS

JP 4090356 B2 * 5/2008

OTHER PUBLICATIONS

Written Opinion and International Search Report dated Jan. 14, 2025, in corresponding PCT/US2024/056224 (10 pages) (mailed Feb. 7, 2025).

*Primary Examiner* — Adriana Figueroa
(74) *Attorney, Agent, or Firm* — Venable LLP

(57) ABSTRACT

This invention, in embodiments, relates to a roofing material having a top edge, a bottom edge that is opposite to the top edge, a first side edge, and a second side edge that is opposite to the first side edge. The roofing material further includes (i) at least one water channel that extends along the first side edge, from the top edge to the bottom edge of the roofing material, and (ii) at least one attachment tab that is disposed on the first side edge. This invention further relates to a roofing system that includes such a roofing material and a method of installing thereof.

16 Claims, 14 Drawing Sheets

(56) References Cited

U.S. PATENT DOCUMENTS

| | | | | |
|---|---|---|---|---|
| 3,347,001 | A * | 10/1967 | Cosden | E04D 3/24 52/522 |
| 3,579,940 | A | 5/1971 | Greenleaf | |
| 3,667,184 | A | 6/1972 | Merrill et al. | |
| 3,862,532 | A * | 1/1975 | Markos | E04D 3/32 52/553 |
| 4,226,069 | A | 10/1980 | Hinds | |
| 4,890,432 | A * | 1/1990 | Shepherd | E04D 1/2916 52/542 |
| 5,613,337 | A | 3/1997 | Plath et al. | |
| 5,644,886 | A | 7/1997 | Ekmark et al. | |
| D413,396 | S | 8/1999 | Thagard, III et al. | |
| 6,282,858 | B1 | 9/2001 | Swick | |
| D478,179 | S | 8/2003 | Fifield | |
| 7,331,150 | B2 * | 2/2008 | Martinique | E04D 1/30 52/525 |
| D595,431 | S | 6/2009 | Day | |
| 7,845,141 | B2 * | 12/2010 | Martinique | E04D 1/30 52/525 |
| D643,548 | S * | 8/2011 | Wakefield | D25/140 |
| D650,921 | S | 12/2011 | Hudson, Jr. et al. | |
| 8,347,587 | B2 | 1/2013 | Thomas | |
| 8,590,270 | B2 * | 11/2013 | Martinique | E04D 1/30 52/525 |
| D711,558 | S | 8/2014 | Bobolts et al. | |
| 9,267,296 | B2 * | 2/2016 | Maurer | E04D 1/2916 |
| D827,160 | S | 8/2018 | Menton | |
| D857,930 | S | 8/2019 | Madimirovich et al. | |
| 10,947,728 | B1 | 3/2021 | Sobrino | |
| 11,384,542 | B2 | 7/2022 | DeRogatis et al. | |
| D966,563 | S | 10/2022 | Truss et al. | |
| 2008/0098684 | A1 | 5/2008 | Martinique | |
| 2020/0378124 | A1 | 12/2020 | Boor et al. | |
| 2023/0003028 | A1 * | 1/2023 | Boss | E04D 3/35 |

* cited by examiner

ROOFING MATERIALS HAVING A WATER CHANNEL AND AN ATTACHMENT TAB AND METHODS OF MAKING AND INSTALLING THEREOF

This application claims the priority of U.S. provisional application Ser. No. U.S. 63/600,356 entitled "Roofing Materials Having a Water Channel and an Attachment Tab and Methods of Making and Installing Thereof" filed Nov. 17, 2023, which is incorporated herein by reference in its entirety for all purposes.

FIELD OF THE INVENTION

This invention relates to roofing materials having at least one water channel and one or more attachment tabs and methods of making and installing these roofing materials. By preparing roofing materials such as, e.g., roofing tiles, having both a water channel and an attachment tab, these roofing materials can facilitate installation and improve wind uplift resistance, as compared to roofing materials not prepared with such features.

BACKGROUND OF THE INVENTION

A large variety of roofing materials, such as, e.g., roofing tiles, exist in the marketplace. Common methods of installing such roofing tiles include the use of various interlocking and/or mounting mechanisms. There is a need, however, for roofing materials such as, e.g., roofing tiles, with improved installation properties and wind uplift resistance.

SUMMARY OF THE INVENTION

One embodiment of this invention pertains to a roofing material comprising a top edge, a bottom edge that is opposite to the top edge, a first side edge, and a second side edge that is opposite to the first side edge. The roofing material further includes (i) a water channel that extends along the first side edge, from the top edge to the bottom edge of the roofing material, and (ii) an attachment tab that is disposed on the first side edge.

In one embodiment, the attachment tab is disposed on the first side edge at a position that is adjacent to the bottom edge of the roofing material.

In one embodiment, the attachment tab is disposed on the first side edge at a position that is along the water channel.

In one embodiment, the roofing material further includes a second attachment tab that is disposed on the second side edge. In one embodiment, the second attachment tab is disposed on the second side edge at a position that is adjacent to the bottom edge of the roofing material. In one embodiment, the second attachment tab is disposed on the second side edge at a position that is opposite to the attachment tab disposed on the first side edge.

In one embodiment, the roofing material includes at least two attachment sites along the top edge of the roofing material, such that each attachment site of the at least two attachment sites is configured to engage with a fastener to attach the roofing material to at least one of (i) a roofing substrate or (ii) another roofing material.

In one embodiment, the roofing material includes an attachment site on the attachment tab, such that the attachment site on the attachment tab is configured to engage with a fastener to attach the roofing material to at least one of (i) a roofing substrate or (ii) another roofing material.

In one embodiment, the roofing substrate comprises a roof deck substrate, a roof deck substrate to which one or more underlayment material layers have been attached, or a combination thereof.

In one embodiment, the roofing material is a roofing tile.

In one embodiment, the roofing material is a synthetic tile.

In one embodiment, the roofing material is configured to attach to a roofing substrate via one or more fasteners. In one embodiment, the roofing material is configured to attach to a roofing substrate via three fasteners. In one embodiment, the roofing material is configured to attach to a roofing substrate via four fasteners.

In one embodiment, the water channel is configured to channel water onto a top surface of an adjacent roofing material.

In one embodiment, the roofing material includes three attachment points to attach the roofing material to at least one of (i) a roofing substrate or (ii) another roofing material. In an embodiment, the roofing material exhibits an increased wind uplift resistance as compared to a roofing material without three attachment points. In an embodiment, the roofing material exhibits an increased wind uplift resistance as compared to a roofing material with only two attachment points.

In one embodiment, the roofing material includes four attachment points to attach the roofing material to at least one of (i) a roofing substrate or (ii) another roofing material. In an embodiment, the roofing material exhibits an increased wind uplift resistance as compared to a roofing material without four attachment points. In an embodiment, the roofing material exhibits an increased wind uplift resistance as compared to a roofing material with only two attachment points.

Another embodiment of this invention pertains to a roofing material comprising a top edge, a bottom edge that is opposite to the top edge, a first side edge, and a second side edge that is opposite to the first side edge. The roofing material further includes (i) a water channel that extends along the first side edge, from the top edge to the bottom edge of the roofing material, (ii) a first attachment tab that is disposed on the first side edge, and (iii) a second attachment tab that is disposed on the second side edge.

In one embodiment, the first attachment tab is disposed on the first side edge at a position that is adjacent to the bottom edge of the roofing material.

In one embodiment, the first attachment tab is disposed on the first side edge at a position that is along the water channel.

In one embodiment, the second attachment tab is disposed on the second side edge at a position that is adjacent to the bottom edge of the roofing material. In one embodiment, the second attachment tab is disposed on the second side edge at a position that is opposite to the first attachment tab disposed on the first side edge.

In one embodiment, the roofing material includes at least two attachment sites along the top edge of the roofing material, such that each attachment site of the at least two attachment sites is configured to engage with a fastener to attach the roofing material to at least one of (i) a roofing substrate or (ii) another roofing material.

In one embodiment, the roofing material includes an attachment site on the first attachment tab, such that the attachment site on the first attachment tab is configured to engage with a fastener to attach the roofing material to at least one of (i) a roofing substrate or (ii) another roofing material.

In one embodiment, the roofing substrate comprises a roof deck substrate, a roof deck substrate to which one or more underlayment material layers have been attached, or a combination thereof.

In one embodiment, the roofing material is a roofing tile.

In one embodiment, the roofing material is a synthetic tile.

In one embodiment, the roofing material is configured to attach to a roofing substrate via one or more fasteners. In one embodiment, the roofing material is configured to attach to a roofing substrate via four fasteners.

In one embodiment, the water channel is configured to channel water onto a top surface of an adjacent roofing material.

In one embodiment, the roofing material includes four attachment points to attach the roofing material to at least one of (i) a roofing substrate or (ii) another roofing material. In an embodiment, the roofing material exhibits an increased wind uplift resistance as compared to a roofing material without four attachment points. In an embodiment, the roofing material exhibits an increased wind uplift resistance as compared to a roofing material with only two attachment points.

Yet another embodiment of this invention pertains to a roofing material comprising a top edge, a bottom edge that is opposite to the top edge, a first side edge, and a second side edge that is opposite to the first side edge. The roofing material further includes (i) a first water channel that extends along the first side edge, from the top edge to the bottom edge of the roofing material, (ii) a second water channel that extends along a middle portion of the roofing material, from the top edge to the bottom edge of the roofing material, and (iii) an attachment tab that is disposed on the first side edge.

In one embodiment, the roofing material further includes a first raised barrel portion that extends from the top edge to the bottom edge of the roofing material in an area between the first water channel and the second water channel. In one embodiment, the roofing material further includes a second raised barrel portion that extends from the top edge to the bottom edge of the roofing material in an area between the second water channel and the second side edge.

In one embodiment, the attachment tab is disposed on the first side edge at a position that is adjacent to the bottom edge of the roofing material.

In one embodiment, the attachment tab is disposed on the first side edge at a position that is along the first water channel.

In one embodiment, the roofing material further includes a raised wall portion along the first water channel that extends from the top edge to the bottom edge of the roofing material.

In one embodiment, the roofing material includes at least two attachment sites along the top edge of the roofing material, such that each attachment site of the at least two attachment sites is configured to engage with a fastener to attach the roofing material to at least one of (i) a roofing substrate or (ii) another roofing material.

In one embodiment, the roofing material further includes a pair of alignment ledges that extends from the top edge to the bottom edge of the roofing material on a bottom surface of the roofing material, with (i) a first alignment ledge of the pair of alignment ledges extending on a portion of the bottom surface of the roofing material that is opposite to the first water channel, and (ii) a second alignment ledge of the pair of alignment ledges extending on a portion of the bottom surface of the roofing material that is opposite to the second water channel.

In one embodiment, the roofing material further includes a pair of hollow portions that extends from the top edge to the bottom edge of the roofing material on a bottom surface of the roofing material, with (i) a first hollow portion of the pair of hollow portions extending on a portion of the bottom surface of the roofing material that is opposite to the first raised barrel portion, and (ii) a second hollow portion of the pair of hollow portions extending on a portion of the bottom surface of the roofing material that is opposite to the second raised barrel portion.

In one embodiment, each of the hollow portions of the pair of hollow portions includes a plurality of support ribs along a surface of the respective hollow portion.

In one embodiment, the roofing substrate comprises a roof deck substrate, a roof deck substrate to which one or more underlayment material layers have been attached, or a combination thereof.

In one embodiment, the roofing material is a roofing tile.

In one embodiment, the roofing material is a synthetic tile.

In one embodiment, the roofing material is configured to attach to a roofing substrate via one or more fasteners. In one embodiment, the roofing material is configured to attach to a roofing substrate via three fasteners.

In one embodiment, each of the first water channel and the second water channel is configured to channel water onto a top surface of an adjacent roofing material.

In one embodiment, the roofing material includes three attachment points to attach the roofing material to at least one of (i) a roofing substrate or (ii) another roofing material. In an embodiment, the roofing material exhibits an increased wind uplift resistance as compared to a roofing material without three attachment points. In an embodiment, the roofing material exhibits an increased wind uplift resistance as compared to a roofing material with only two attachment points.

Another embodiment of this invention pertains to a roofing system comprising (a) a roofing substrate, (b) a first roofing material overlying the roofing substrate, the first roofing material having a top edge, a bottom edge that is opposite to the top edge, a first side edge, and a second side edge that is opposite to the first side edge, and (c) a second roofing material overlying the first roofing material, the second roofing material having a top edge, a bottom edge that is opposite to the top edge, a first side edge, and a second side edge that is opposite to the first side edge. Each of the first roofing material and the second roofing material further includes (i) a water channel that extends along the first side edge of the respective roofing material, from the top edge to the bottom edge of the respective roofing material, and (ii) an attachment tab that is disposed on the first side edge of the respective roofing material.

In one embodiment, the attachment tab is disposed on the first side edge of the respective roofing material at a position that is adjacent to the bottom edge of the respective roofing material.

In one embodiment, the attachment tab is disposed on the first side edge of the respective roofing material at a position that is along the water channel of the respective roofing material.

In one embodiment, each of the first roofing material and the second roofing material further includes a second attachment tab that is disposed on the second side edge of the respective roofing material. In one embodiment, the second attachment tab is disposed on the second side edge of the respective roofing material at a position that is adjacent to the bottom edge of the respective roofing material. In one embodiment, the second attachment tab is disposed on the second side edge of the respective roofing material at a position that is opposite to the attachment tab disposed on the first side edge of the respective roofing material.

In one embodiment, each of the first roofing material and the second roofing material includes at least two attachment sites along the top edge of the respective roofing material, such that each attachment site of the at least two attachment sites is configured to engage with a fastener to attach the respective roofing material to at least one of (i) the roofing substrate or (ii) another roofing material.

In one embodiment, each of the first roofing material and the second roofing material includes an attachment site on the attachment tab of the respective roofing material, such that the attachment site on the attachment tab is configured to engage with a fastener to attach the respective roofing material to at least one of (i) the roofing substrate or (ii) another roofing material.

In one embodiment, the roofing substrate comprises a roof deck substrate, a roof deck substrate to which one or more underlayment material layers have been attached, or a combination thereof.

In one embodiment, the first roofing material and the second roofing material are roofing tiles.

In some embodiments, the first roofing material and the second roofing material are interlocking tiles.

In one embodiment, the first roofing material and the second roofing material are synthetic tiles.

In one embodiment, each of the first roofing material and the second roofing material is attached to the roofing substrate via one or more fasteners. In one embodiment, each of the first roofing material and the second roofing material is attached to the roofing substrate via three fasteners. In one embodiment, each of the first roofing material and the second roofing material is attached to the roofing substrate via four fasteners.

In one embodiment, the water channel of at least one of the first roofing material and the second roofing material is configured to channel water onto a top surface of an adjacent roofing material.

In one embodiment, the water channel of the second roofing material is configured to channel water onto a top surface of the first roofing material.

In one embodiment, each of the first roofing material and the second roofing material includes three attachment points to attach the respective roofing material to at least one of (i) the roofing substrate or (ii) another roofing material. In an embodiment, each of the first roofing material and the second roofing material exhibits an increased wind uplift resistance as compared to a roofing material without three attachment points. In an embodiment, each of the first roofing material and the second roofing material exhibits an increased wind uplift resistance as compared to a roofing material with only two attachment points.

In one embodiment, each of the first roofing material and the second roofing material includes four attachment points to attach the respective roofing material to at least one of (i) the roofing substrate or (ii) another roofing material. In an embodiment, each of the first roofing material and the second roofing material exhibits an increased wind uplift resistance as compared to a roofing material without four attachment points. In an embodiment, each of the first roofing material and the second roofing material exhibits an increased wind uplift resistance as compared to a roofing material with only two attachment points.

Another embodiment of this invention pertains to a roofing system comprising (a) a roofing substrate, (b) a first roofing material overlying the roofing substrate, the first roofing material having a top edge, a bottom edge that is opposite to the top edge, a first side edge, and a second side edge that is opposite to the first side edge, and (c) a second roofing material overlying the first roofing material, the second roofing material having a top edge, a bottom edge that is opposite to the top edge, a first side edge, and a second side edge that is opposite to the first side edge. Each of the first roofing material and the second roofing material further includes (i) a water channel that extends along the first side edge, from the top edge to the bottom edge of the roofing material, (ii) a first attachment tab that is disposed on the first side edge, and (iii) a second attachment tab that is disposed on the second side edge.

In one embodiment, the first attachment tab is disposed on the first side edge of the respective roofing material at a position that is adjacent to the bottom edge of the respective roofing material.

In one embodiment, the first attachment tab is disposed on the first side edge of the respective roofing material at a position that is along the water channel of the respective roofing material.

In one embodiment, the second attachment tab is disposed on the second side edge of the respective roofing material at a position that is adjacent to the bottom edge of the respective roofing material. In one embodiment, the second attachment tab is disposed on the second side edge of the respective roofing material at a position that is opposite to the first attachment tab disposed on the first side edge of the respective roofing material.

In one embodiment, each of the first roofing material and the second roofing material includes at least two attachment sites along the top edge of the respective roofing material, such that each attachment site of the at least two attachment sites is configured to engage with a fastener to attach the respective roofing material to at least one of (i) the roofing substrate or (ii) another roofing material.

In one embodiment, each of the first roofing material and the second roofing material includes an attachment site on the first attachment tab of the respective roofing material, such that the attachment site on the first attachment tab is configured to engage with a fastener to attach the respective roofing material to at least one of (i) the roofing substrate or (ii) another roofing material.

In one embodiment, the roofing substrate comprises a roof deck substrate, a roof deck substrate to which one or more underlayment material layers have been attached, or a combination thereof.

In one embodiment, the first roofing material and the second roofing material are roofing tiles.

In some embodiments, the first roofing material and the second roofing material are interlocking tiles.

In one embodiment, the first roofing material and the second roofing material are synthetic tiles.

In one embodiment, each of the first roofing material and the second roofing material is attached to the roofing substrate via one or more fasteners. In one embodiment, each of the first roofing material and the second roofing material is attached to the roofing substrate via three fasteners. In one embodiment, each of the first roofing material and the second roofing material is attached to the roofing substrate via four fasteners.

In one embodiment, the water channel of at least one of the first roofing material and the second roofing material is configured to channel water onto a top surface of an adjacent roofing material.

In one embodiment, the water channel of the second roofing material is configured to channel water onto a top surface of the first roofing material.

In one embodiment, each of the first roofing material and the second roofing material includes four attachment points to attach the respective roofing material to at least one of (i) the roofing substrate or (ii) another roofing material. In an embodiment, each of the first roofing material and the second roofing material exhibits an increased wind uplift resistance as compared to a roofing material without four attachment points. In an embodiment, each of the first roofing material and the second roofing material exhibits an increased wind uplift resistance as compared to a roofing material with only two attachment points.

Another embodiment of this invention pertains to a roofing system comprising (a) a roofing substrate, (b) a first roofing material overlying the roofing substrate, the first roofing material having a top edge, a bottom edge that is opposite to the top edge, a first side edge, and a second side edge that is opposite to the first side edge, and (c) a second roofing material overlying the first roofing material, the second roofing material having a top edge, a bottom edge that is opposite to the top edge, a first side edge, and a second side edge that is opposite to the first side edge. Each of the first roofing material and the second roofing material further includes (i) a first water channel that extends along the first side edge, from the top edge to the bottom edge of the roofing material, (ii) a second water channel that extends along a middle portion of the roofing material, from the top edge to the bottom edge of the roofing material, and (iii) an attachment tab that is disposed on the first side edge.

In one embodiment, each of the first roofing material and the second roofing material further includes a first raised barrel portion that extends from the top edge to the bottom edge of the respective roofing material in an area between the first water channel and the second water channel of the respective roofing material. In one embodiment, each of the first roofing material and the second roofing material further includes a second raised barrel portion that extends from the top edge to the bottom edge of the respective roofing material in an area between the second water channel and the second side edge of the respective roofing material.

In one embodiment, the attachment tab is disposed on the first side edge of the respective roofing material at a position that is adjacent to the bottom edge of the respective roofing material.

In one embodiment, the attachment tab is disposed on the first side edge of the respective roofing material at a position that is along the first water channel of the respective roofing material.

In one embodiment, each of the first roofing material and the second roofing material further includes further includes a raised wall portion along the first water channel of the respective roofing material that extends from the top edge to the bottom edge of the respective roofing material.

In one embodiment, each of the first roofing material and the second roofing material includes at least two attachment sites along the top edge of the respective roofing material, such that each attachment site of the at least two attachment sites is configured to engage with a fastener to attach the respective roofing material to at least one of (i) the roofing substrate or (ii) another roofing material.

In one embodiment, each of the first roofing material and the second roofing material further includes a pair of alignment ledges that extends from the top edge to the bottom edge of the respective roofing material on a bottom surface of the respective roofing material, with (i) a first alignment ledge of the pair of alignment ledges extending on a portion of the bottom surface of the respective roofing material that is opposite to the first water channel of the respective roofing material, and (ii) a second alignment ledge of the pair of alignment ledges extending on a portion of the bottom surface of the respective roofing material that is opposite to the second water channel of the respective roofing material.

In one embodiment, each of the first roofing material and the second roofing material further includes a pair of hollow portions that extends from the top edge to the bottom edge of the respective roofing material on a bottom surface of the respective roofing material, with (i) a first hollow portion of the pair of hollow portions extending on a portion of the bottom surface of the respective roofing material that is opposite to the first raised barrel portion of the respective roofing material, and (ii) a second hollow portion of the pair of hollow portions extending on a portion of the bottom surface of the respective roofing material that is opposite to the second raised barrel portion of the respective roofing material.

In one embodiment, each of the hollow portions of the pair of hollow portions includes a plurality of support ribs along a surface of the respective hollow portion.

In one embodiment, each of the first roofing material and the second roofing material includes an attachment site on the attachment tab of the respective roofing material, such that the attachment site on the attachment tab is configured to engage with a fastener to attach the respective roofing material to at least one of (i) the roofing substrate or (ii) another roofing material.

In one embodiment, the roofing substrate comprises a roof deck substrate, a roof deck substrate to which one or more underlayment material layers have been attached, or a combination thereof.

In one embodiment, the first roofing material and the second roofing material are roofing tiles.

In some embodiments, the first roofing material and the second roofing material are interlocking tiles.

In one embodiment, the first roofing material and the second roofing material are synthetic tiles.

In one embodiment, each of the first roofing material and the second roofing material is attached to the roofing substrate via one or more fasteners. In one embodiment, each of the first roofing material and the second roofing material is attached to the roofing substrate via three fasteners.

In one embodiment, each of the first water channel and the second water channel of at least one of the first roofing material and the second roofing material is configured to channel water onto a top surface of an adjacent roofing material.

In one embodiment, each of the first water channel and the second water channel of the second roofing material is configured to channel water onto a top surface of the first roofing material.

In one embodiment, each of the first roofing material and the second roofing material includes three attachment points to attach the respective roofing material to at least one of (i) the roofing substrate or (ii) another roofing material. In an embodiment, each of the first roofing material and the second roofing material exhibits an increased wind uplift resistance as compared to a roofing material without three attachment points. In an embodiment, each of the first roofing material and the second roofing material exhibits an increased wind uplift resistance as compared to a roofing material with only two attachment points.

Another embodiment of this invention pertains to a method of installing roofing materials onto a roofing substrate. The method comprises obtaining a first roofing material having a top edge, a bottom edge that is opposite to the top edge, a first side edge, and a second side edge that is opposite to the first side edge, obtaining a second roofing material having a top edge, a bottom edge that is opposite to the top edge, a first side edge, and a second side edge that is opposite to the first side edge, and installing the first and second roofing materials to the roofing substrate, such that the second roofing material overlays at least a portion of the first roofing material. Each of the first roofing material and the second roofing material further includes (i) a water channel that extends along the first side edge of the respective roofing material, from the top edge to the bottom edge of the respective roofing material, and (ii) an attachment tab that is disposed on the first side edge of the respective roofing material.

In one embodiment, the attachment tab is disposed on the first side edge of the respective roofing material at a position that is adjacent to the bottom edge of the respective roofing material.

In one embodiment, the attachment tab is disposed on the first side edge of the respective roofing material at a position that is along the water channel of the respective roofing material.

In one embodiment, each of the first roofing material and the second roofing material further includes a second attachment tab that is disposed on the second side edge of the respective roofing material. In one embodiment, the second attachment tab is disposed on the second side edge of the respective roofing material at a position that is adjacent to the bottom edge of the respective roofing material. In one embodiment, the second attachment tab is disposed on the second side edge of the respective roofing material at a position that is opposite to the attachment tab disposed on the first side edge of the respective roofing material.

In one embodiment, each of the first roofing material and the second roofing material includes at least two attachment sites along the top edge of the respective roofing material, such that each attachment site of the at least two attachment sites is configured to engage with a fastener to attach the respective roofing material to at least one of (i) the roofing substrate or (ii) another roofing material.

In one embodiment, each of the first roofing material and the second roofing material includes an attachment site on the attachment tab of the respective roofing material, such that the attachment site on the attachment tab is configured to engage with a fastener to attach the respective roofing material to at least one of (i) the roofing substrate or (ii) another roofing material.

In one embodiment, the roofing substrate comprises a roof deck substrate, a roof deck substrate to which one or more underlayment material layers have been attached, or a combination thereof.

In one embodiment, the first roofing material and the second roofing material are roofing tiles.

In some embodiments, the first roofing material and the second roofing material are interlocking tiles.

In one embodiment, the first roofing material and the second roofing material are synthetic tiles.

In one embodiment, the method further comprises attaching the first roofing material and the second roofing material to the roofing substrate via fasteners. In one embodiment, the method further comprises attaching the first roofing material and the second roofing material to the roofing substrate via three fasteners. In one embodiment, the method further comprises attaching the first roofing material and the second roofing material to the roofing substrate via four fasteners.

In one embodiment, the water channel of at least one of the first roofing material and the second roofing material is configured to channel water onto a top surface of an adjacent roofing material.

In one embodiment, the water channel of the second roofing material is configured to channel water onto a top surface of the first roofing material.

In one embodiment, each of the first roofing material and the second roofing material includes three attachment points to attach the respective roofing material to at least one of (i) the roofing substrate or (ii) another roofing material.

In one embodiment, each of the first roofing material and the second roofing material includes four attachment points to attach the respective roofing material to at least one of (i) the roofing substrate or (ii) another roofing material.

Yet another embodiment of this invention pertains to a method of installing roofing materials onto a roofing substrate. The method comprises obtaining a first roofing material having a top edge, a bottom edge that is opposite to the top edge, a first side edge, and a second side edge that is opposite to the first side edge, obtaining a second roofing material having a top edge, a bottom edge that is opposite to the top edge, a first side edge, and a second side edge that is opposite to the first side edge, and installing the first and second roofing materials to the roofing substrate, such that the second roofing material overlays at least a portion of the first roofing material. Each of the first roofing material and the second roofing material further includes (i) a water channel that extends along the first side edge, from the top edge to the bottom edge of the respective roofing material, (ii) a first attachment tab that is disposed on the first side edge of the respective roofing material, and (iii) a second attachment tab that is disposed on the second side edge of the respective roofing material.

In one embodiment, the first attachment tab is disposed on the first side edge of the respective roofing material at a position that is adjacent to the bottom edge of the respective roofing material.

In one embodiment, the first attachment tab is disposed on the first side edge of the respective roofing material at a position that is along the water channel of the respective roofing material.

In one embodiment, the second attachment tab is disposed on the second side edge of the respective roofing material at a position that is adjacent to the bottom edge of the respective roofing material. In one embodiment, the second attachment tab is disposed on the second side edge of the respective roofing material at a position that is opposite to the first attachment tab disposed on the first side edge of the respective roofing material.

In one embodiment, each of the first roofing material and the second roofing material includes at least two attachment sites along the top edge of the respective roofing material, such that each attachment site of the at least two attachment sites is configured to engage with a fastener to attach the respective roofing material to at least one of (i) the roofing substrate or (ii) another roofing material.

In one embodiment, each of the first roofing material and the second roofing material includes an attachment site on the first attachment tab of the respective roofing material, such that the attachment site on the first attachment tab is configured to engage with a fastener to attach the respective roofing material to at least one of (i) the roofing substrate or (ii) another roofing material.

In one embodiment, the roofing substrate comprises a roof deck substrate, a roof deck substrate to which one or more underlayment material layers have been attached, or a combination thereof.

In one embodiment, the first roofing material and the second roofing material are roofing tiles.

In some embodiments, the first roofing material and the second roofing material are interlocking tiles.

In one embodiment, the first roofing material and the second roofing material are synthetic tiles.

In one embodiment, the method further comprises attaching the first roofing material and the second roofing material to the roofing substrate via fasteners. In one embodiment, the method further comprises attaching the first roofing material and the second roofing material to the roofing substrate via three fasteners. In one embodiment, the method further comprises attaching the first roofing material and the second roofing material to the roofing substrate via four fasteners.

In one embodiment, the water channel of at least one of the first roofing material and the second roofing material is configured to channel water onto a top surface of an adjacent roofing material.

In one embodiment, the water channel of the second roofing material is configured to channel water onto a top surface of the first roofing material.

In one embodiment, each of the first roofing material and the second roofing material includes four attachment points to attach the respective roofing material to at least one of (i) the roofing substrate or (ii) another roofing material.

Another embodiment of this invention pertains to a method of installing roofing materials onto a roofing substrate. The method comprises obtaining a first roofing material having a top edge, a bottom edge that is opposite to the top edge, a first side edge, and a second side edge that is opposite to the first side edge, obtaining a second roofing material having a top edge, a bottom edge that is opposite to the top edge, a first side edge, and a second side edge that is opposite to the first side edge, and installing the first and second roofing materials to the roofing substrate, such that the second roofing material overlays at least a portion of the first roofing material. Each of the first roofing material and the second roofing material further includes (i) a first water channel that extends along the first side edge, from the top edge to the bottom edge of the respective roofing material, (ii) a second water channel that extends along a middle portion of the respective roofing material, from the top edge to the bottom edge of the roofing material, and (iii) an attachment tab that is disposed on the first side edge of the respective roofing material.

In one embodiment, each of the first roofing material and the second roofing material further includes a first raised barrel portion that extends from the top edge to the bottom edge of the respective roofing material in an area between the first water channel and the second water channel of the respective roofing material. In one embodiment, each of the first roofing material and the second roofing material further includes a second raised barrel portion that extends from the top edge to the bottom edge of the respective roofing material in an area between the second water channel and the second side edge of the respective roofing material.

In one embodiment, the attachment tab is disposed on the first side edge of the respective roofing material at a position that is adjacent to the bottom edge of the respective roofing material.

In one embodiment, the attachment tab is disposed on the first side edge of the respective roofing material at a position that is along the first water channel of the respective roofing material.

In one embodiment, each of the first roofing material and the second roofing material further includes a raised wall portion along the first water channel of the respective roofing material that extends from the top edge to the bottom edge of the respective roofing material.

In one embodiment, each of the first roofing material and the second roofing material includes at least two attachment sites along the top edge of the respective roofing material, such that each attachment site of the at least two attachment sites is configured to engage with a fastener to attach the respective roofing material to at least one of (i) the roofing substrate or (ii) another roofing material.

In one embodiment, each of the first roofing material and the second roofing material further includes a pair of alignment ledges that extends from the top edge to the bottom edge of the respective roofing material on a bottom surface of the respective roofing material, with (i) a first alignment ledge of the pair of alignment ledges extending on a portion of the bottom surface of the respective roofing material that is opposite to the first water channel of the respective roofing material, and (ii) a second alignment ledge of the pair of alignment ledges extending on a portion of the bottom surface of the respective roofing material that is opposite to the second water channel of the respective roofing material.

In one embodiment, each of the first roofing material and the second roofing material further includes a pair of hollow portions that extends from the top edge to the bottom edge of the respective roofing material on a bottom surface of the respective roofing material, with (i) a first hollow portion of the pair of hollow portions extending on a portion of the bottom surface of the respective roofing material that is opposite to the first raised barrel portion of the respective roofing material, and (ii) a second hollow portion of the pair of hollow portions extending on a portion of the bottom surface of the respective roofing material that is opposite to the second raised barrel portion of the respective roofing material.

In one embodiment, each of the hollow portions of the pair of hollow portions includes a plurality of support ribs along a surface of the respective hollow portion.

In one embodiment, each of the first roofing material and the second roofing material includes an attachment site on the attachment tab of the respective roofing material, such that the attachment site on the attachment tab is configured to engage with a fastener to attach the respective roofing material to at least one of (i) the roofing substrate or (ii) another roofing material.

In one embodiment, the roofing substrate comprises a roof deck substrate, a roof deck substrate to which one or more underlayment material layers have been attached, or a combination thereof.

In one embodiment, the first roofing material and the second roofing material are roofing tiles.

In some embodiments, the first roofing material and the second roofing material are interlocking tiles.

In one embodiment, the first roofing material and the second roofing material are synthetic tiles.

In one embodiment, the method further comprises attaching the first roofing material and the second roofing material to the roofing substrate via fasteners. In one embodiment, the method further comprises attaching the first roofing material and the second roofing material to the roofing substrate via three fasteners.

In one embodiment, each of the first water channel and the second water channel of at least one of the first roofing material and the second roofing material is configured to channel water onto a top surface of an adjacent roofing material.

In one embodiment, each of the first water channel and the second water channel of the second roofing material is configured to channel water onto a top surface of the first roofing material.

In one embodiment, each of the first roofing material and the second roofing material includes three attachment points to attach the respective roofing material to at least one of (i) the roofing substrate or (ii) another roofing material.

BRIEF DESCRIPTION OF THE FIGURES

For a more complete understanding of the invention and the advantages thereof, reference is made to the following descriptions, taken in conjunction with the accompanying figures, in which.

DETAILED DESCRIPTION OF THE INVENTION

Figure 1:
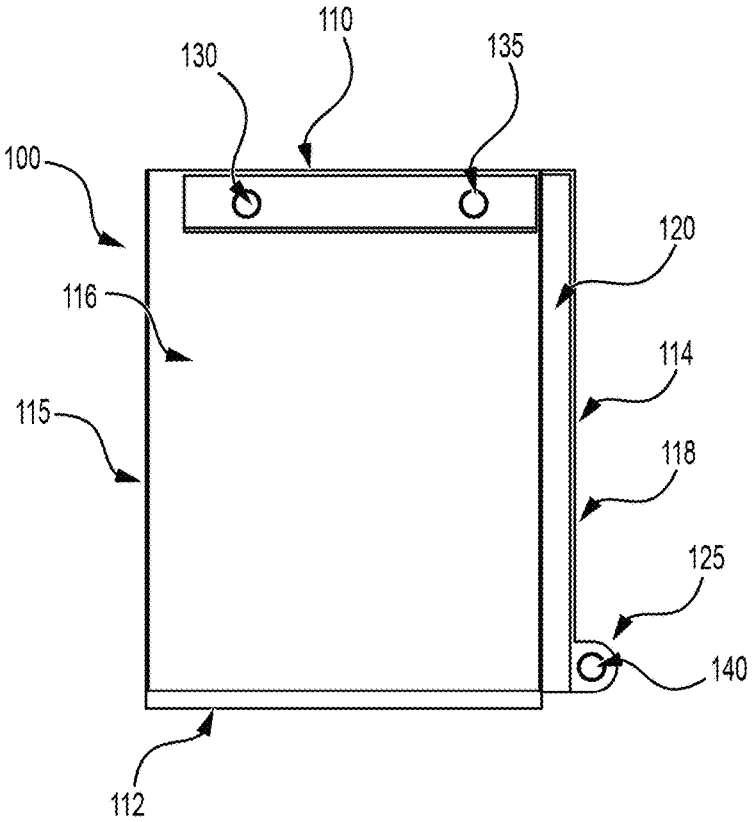
FIG. 1 is an illustration of a roofing material having a water channel and an attachment tab according to one embodiment of the invention.

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, terms such as "consisting of" limit the scope of a specific claim to the materials and steps recited by the claim.

All prior patents, publications, and test methods referenced herein are incorporated by reference in their entireties.

This invention, in embodiments, relates to an improved roofing material (e.g., a roofing tile) having a water channel and an attachment tab (e.g., a nail tab) along the same side edge (e.g., right hand side) of the roofing tile that allows for improved (or increased) wind uplift resistance or performance, while also facilitating installation. This invention, in embodiments, relates to an improvement in existing tile designs (including, e.g., interlocking tile designs) to both improve wind uplift performance (via the inclusion of a bottom attachment tab) and ease of installation (by allowing all three attachment points to be installed prior to the positioning and attachment of the next tile in a course). In this regard, the benefits are two-fold, which is that the inclusion of a bottom-side attachment tab dramatically improves wind uplift, while allowing for a less complex installation since the attachment tab is on the same side as an interlocking water channel element, as opposed to the attachment tab being positioned on the opposite (vertical) side from the interlocking water channel element, which requires a significantly more complex and time-consuming installation process. The proposed invention mitigates this issue by allowing the tile to be secured at all three points of attachment prior to the next tile being installed.

This invention, in embodiments, further relates to an improved roofing material (e.g., a roofing tile) having a water channel and an attachment tab (e.g., a nail tab) along the same side edge (e.g., right hand side) of the roofing tile, as well as a fourth restraining point (e.g., another or second attachment tab), such as, e.g., a mechanically interlocking tab, positioned on a left or opposite bottom corner of the roofing material as the first attachment tab, to prevent the roofing material (e.g., tile) from curling up when in use and to enhance uplift resistance and uplift bend in response to bending forces and thermal loads. The bottom left interlocking mechanism can be achieved by adding another (or a second) attachment tab at the bottom left corner, which interlocks with an adjacent roofing material (e.g., tile), or by other mechanical interlocking techniques, such as, e.g., mechanically interlocking the bottom right side tab to an adjacent roofing material (e.g., tile). The additional bottom left side interlocking mechanism will also serve as a means to set the distance between adjacent roofing material bodies to the same distance (including, for example, to ⅛ inch). The fourth left side restraining point will mechanically interlock with the adjacent roofing material (or tile body) next to the first attachment tab, and can be restrained through a mechanical interlock and without a fastener.

One embodiment of this invention pertains to a roofing material comprising a top edge, a bottom edge that is opposite to the top edge, a first side edge, and a second side edge that is opposite to the first side edge. The roofing material further includes (i) a water channel that extends along the first side edge, from the top edge to the bottom edge of the roofing material, and (ii) an attachment tab that is disposed on the first side edge.

FIG. 1 illustrates a roofing material 100 (e.g., roofing tile) according to an embodiment of the invention. According to this embodiment, the roofing material 100 includes a top edge 110, a bottom edge 112 that is opposite to the top edge 110, a first side edge 114, and a second side edge 115 that is opposite to the first side edge 114. The roofing material 100 also includes a top surface 116 and a bottom surface 118. The roofing material 100 further includes (i) a water channel 120 that extends along the first side edge 114, from the top edge 110 to the bottom edge 112 of the roofing material 100, and (ii) an attachment tab 125 that is disposed on the first side edge 114 of the roofing material 100.

In one embodiment, which is shown in FIG. 1, the attachment tab 125 is disposed on the first side edge 114 at a position that is adjacent to the bottom edge 112 of the roofing material 100.

In one embodiment, which is shown in FIG. 1, the attachment tab 125 is disposed on the first side edge 114 at a position that is along the water channel 120.

In one embodiment, the roofing material includes at least two attachment sites along the top edge of the roofing material, such that each attachment site of the at least two attachment sites is configured to engage with a fastener to attach the roofing material to at least one of (i) a roofing substrate or (ii) another roofing material. For example, as shown in the embodiment of FIG. 1, the roofing material 100 includes a first attachment site 130 and a second attachment site 135 along the top edge 110 of the roofing material 100, with each of the first attachment site 130 and the second attachment site 135 being configured to engage with a fastener (not shown) (such as, e.g., a nail, screw, bolt, etc.) to attach the roofing material 100 to at least one of (i) a roofing substrate or (ii) another roofing material (see, e.g., FIG. 3).

In one embodiment, the roofing material includes an attachment site on the attachment tab, such that the attachment site on the attachment tab is configured to engage with a fastener to attach the roofing material to at least one of (i) a roofing substrate or (ii) another roofing material. For example, as shown in the embodiment of FIG. 1, the roofing material 100 includes an attachment site 140 (or third attachment site) on the attachment tab 125, with the attachment site 140 (or third attachment site) being configured to engage with a fastener (not shown) (such as, e.g., a nail, screw, bolt, etc.) to attach the roofing material 100 to at least one of (i) a roofing substrate or (ii) another roofing material (see, e.g., FIG. 3).

Figure 2A:
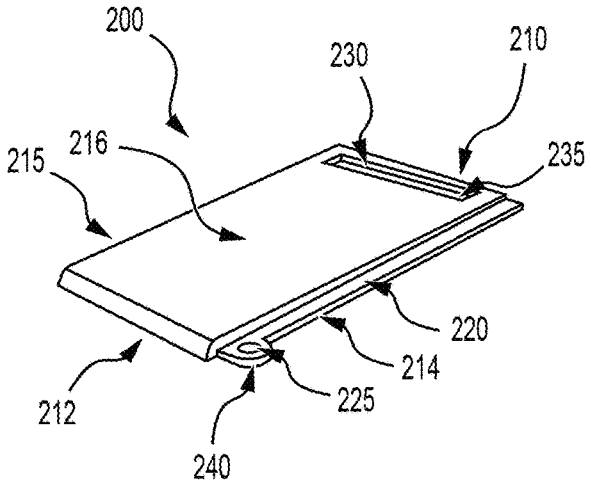
FIG. 2A illustrates a front or top side view of a roofing material having a water channel and an attachment tab according to one embodiment of the invention.
Figure 2B:
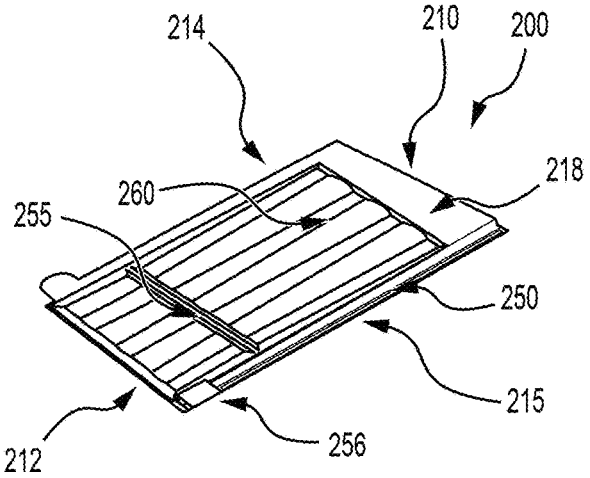
FIG. 2B illustrates a back or bottom side view of the roofing material of FIG. 2A having a water channel and an attachment tab according to one embodiment of the invention.

FIGS. 2A and 2B illustrate another embodiment of a roofing material (e.g., roofing tile) according to an embodiment of the invention. According to this embodiment, a roofing tile 200 includes a top edge 210, a bottom edge 212 that is opposite to the top edge 210, a first side edge 214, and a second side edge 215 that is opposite to the first side edge 214. The roofing material 200 also includes a top surface 216 (see, e.g., FIG. 2A) and a bottom surface 218 (see, e.g., FIG. 2B). The roofing material 200 further includes (i) a water channel 220 that extends along the first side edge 214, from the top edge 210 to the bottom edge 212 of the roofing material 200, and (ii) an attachment tab 225 that is disposed on the first side edge 214 of the roofing material 200. As further shown in FIG. 2A, the roofing material 200 also includes a first attachment site 230 and a second attachment site 235 along the top edge 210 of the roofing material 200, with each of the first attachment site 230 and the second attachment site 235 being configured to engage with a fastener (not shown) (such as, e.g., a nail, screw, bolt, etc.) to attach the roofing material 200 to at least one of (i) a roofing substrate or (ii) another roofing material (see, e.g., FIG. 3). The roofing material 200 also includes an attachment site 240 (or third attachment site) on the attachment tab 225, with the attachment site 240 (or third attachment site) being configured to engage with a fastener (not shown) (such as, e.g., a nail, screw, bolt, etc.) to attach the roofing material 200 to at least one of (i) a roofing substrate or (ii) another roofing material (see, e.g., FIG. 3).

As shown in the embodiment of FIG. 2B, which illustrates a back side or bottom view of the roofing material 200, the bottom surface 218 of the roofing material 200 includes a tile-to-tile interlocking feature 250, which is configured to interlock with a water channel of another roofing material (not shown). As shown in the embodiment of FIG. 2B, the bottom surface 218 of the roofing material 200 further includes (i) an alignment rib 255, which is configured to align the roofing material 200 with an underlying roofing material (not shown), and (ii) a tab insert zone 256, which is configured to engage with an attachment (or alignment) tab of another roofing material (not shown). As also shown in the embodiment of FIG. 2B, the bottom surface 218 of the roofing material 200 includes engineered structural features 260, which improve stress distribution and allow for easier manufacturability.

Another embodiment of this invention pertains to a roofing material comprising a top edge, a bottom edge that is opposite to the top edge, a first side edge, and a second side edge that is opposite to the first side edge. The roofing material further includes (i) a water channel that extends along the first side edge, from the top edge to the bottom edge of the roofing material, (ii) a first attachment tab that is disposed on the first side edge, and (iii) a second attachment tab that is disposed on the second side edge.

Figure 5:
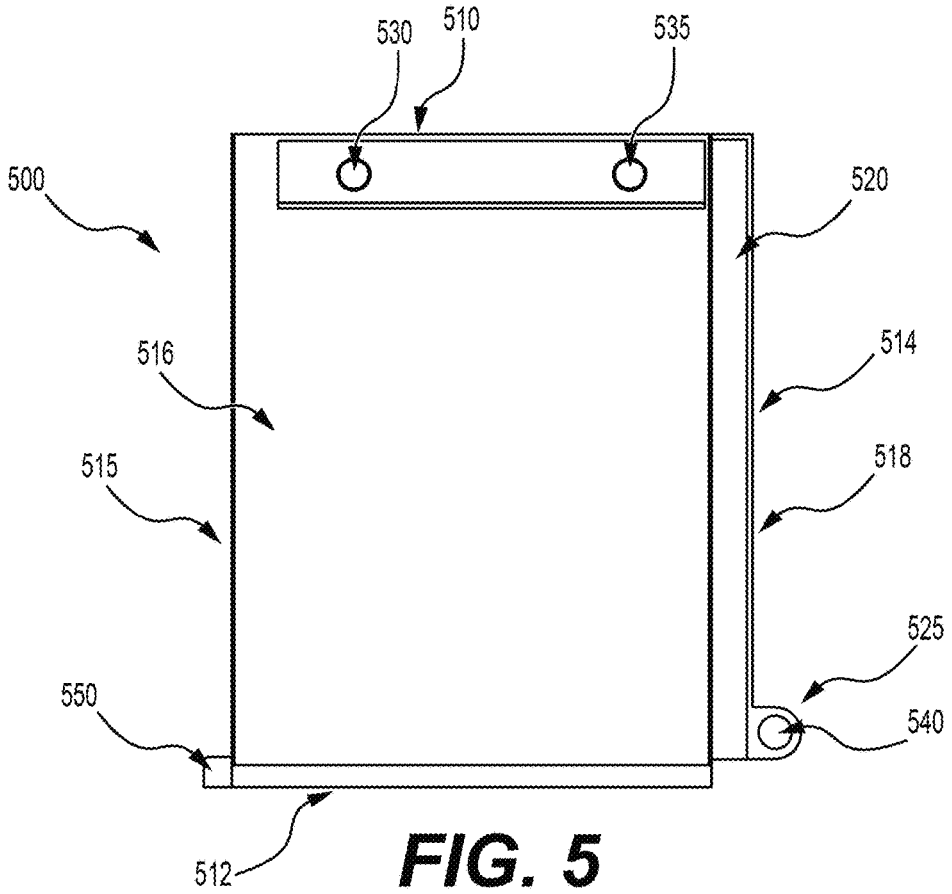
FIG. 5 is an illustration of a roofing material having a water channel and a first and second attachment tab according to one embodiment of the invention.

FIG. 5 illustrates a roofing material 500 (e.g., roofing tile) according to an embodiment of the invention. According to this embodiment, the roofing material 500 includes a top edge 510, a bottom edge 512 that is opposite to the top edge 510, a first side edge 514, and a second side edge 515 that is opposite to the first side edge 514. The roofing material 500 also includes a top surface 516 and a bottom surface 518. The roofing material 500 further includes (i) a water channel 520 that extends along the first side edge 514, from the top edge 510 to the bottom edge 512 of the roofing material 500, (ii) a first attachment tab 525 that is disposed on the first side edge 514 of the roofing material 500, and (iii) a second attachment tab 550 that is disposed on the second side edge 515 of the roofing material 500.

In one embodiment, which is shown in FIG. 5, the first attachment tab 525 is disposed on the first side edge 514 at a position that is adjacent to the bottom edge 512 of the roofing material 500.

In one embodiment, which is shown in FIG. 5, the first attachment tab 525 is disposed on the first side edge 514 at a position that is along the water channel 520 of the roofing material 500.

In one embodiment, which is shown in FIG. 5, the second attachment tab 550 is disposed on the second side edge 515 at a position that is adjacent to the bottom edge 512 of the roofing material 500. In one embodiment, which is shown in FIG. 5, the second attachment tab 550 is disposed on the second side edge 515 at a position that is opposite to the first attachment tab 525 disposed on the first side edge 514 of the roofing material 500.

In one embodiment, the roofing material includes at least two attachment sites along the top edge of the roofing material, such that each attachment site of the at least two attachment sites is configured to engage with a fastener to attach the roofing material to at least one of (i) a roofing substrate or (ii) another roofing material. For example, as shown in the embodiment of FIG. 5, the roofing material 500 includes a first attachment site 530 and a second attachment site 535 along the top edge 510 of the roofing material 500, with each of the first attachment site 530 and the second attachment site 535 being configured to engage with a fastener (not shown) (such as, e.g., a nail, screw, bolt, etc.) to attach the roofing material 500 to at least one of (i) a roofing substrate or (ii) another roofing material.

In one embodiment, the roofing material includes an attachment site on the first attachment tab, such that the attachment site on the first attachment tab is configured to engage with a fastener to attach the roofing material to at least one of (i) a roofing substrate or (ii) another roofing material. For example, as shown in the embodiment of FIG. 5, the roofing material 500 includes an attachment site 540 (or third attachment site) on the first attachment tab 525, with the attachment site 540 (or third attachment site) being configured to engage with a fastener (not shown) (such as, e.g., a nail, screw, bolt, etc.) to attach the roofing material 500 to at least one of (i) a roofing substrate or (ii) another roofing material.

Figure 6A:
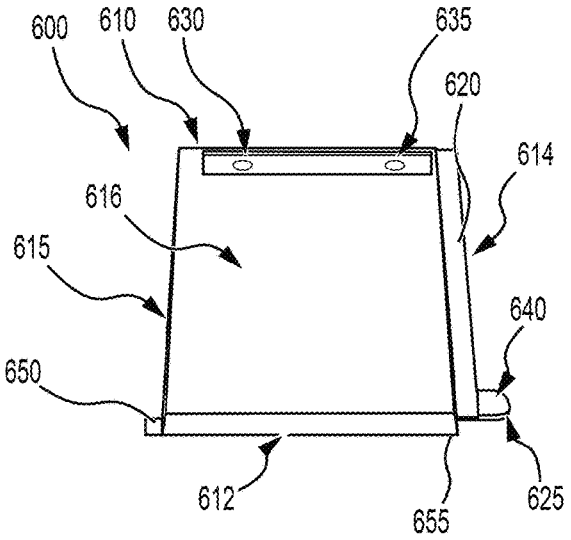
FIG. 6A illustrates a front or top side view of a roofing material having a water channel and a first and second attachment tab according to one embodiment of the invention.
Figure 6B:
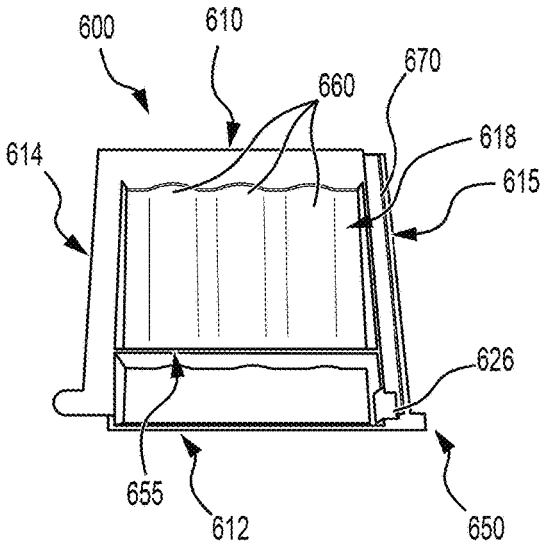
FIG. 6B illustrates a back or bottom side view of the roofing material of FIG. 6A having a water channel and a first and second attachment tab according to one embodiment of the invention.

FIGS. 6A and 6B illustrate another embodiment of a roofing material (e.g., roofing tile) according to an embodiment of the invention. According to this embodiment, a roofing tile 600 includes a top edge 610, a bottom edge 612 that is opposite to the top edge 610, a first side edge 614, and a second side edge 615 that is opposite to the first side edge 614. The roofing material 600 also includes a top surface 616 (see, e.g., FIG. 6A) and a bottom surface 618 (see, e.g., FIG. 6B). The roofing material 600 further includes (i) a water channel 620 that extends along the first side edge 614, from the top edge 610 to the bottom edge 612 of the roofing material 600, (ii) a first attachment tab 625 that is disposed on the first side edge 614 of the roofing material 600, and (iii) a second attachment tab 650 that is disposed on the second side edge 615 of the roofing material 600. As further shown in FIG. 6A, the roofing material 600 also includes a first attachment site 630 (or anchor location) and a second attachment site 635 (or anchor location) along the top edge 610 of the roofing material 600, with each of the first attachment site 630 and the second attachment site 635 being configured to engage with a fastener (not shown) (such as, e.g., a nail, screw, bolt, etc.) to attach the roofing material 600 to at least one of (i) a roofing substrate or (ii) another roofing material. The roofing material 600 also includes an attachment site 640 (or third attachment site or anchor location) on the first attachment tab 625, with the attachment site 640 (or third attachment site) being configured to engage with a fastener (not shown) (such as, e.g., a nail, screw, bolt, etc.) to attach the roofing material 600 to at least one of (i) a roofing substrate or (ii) another roofing material. As further shown in FIG. 6A, the roofing material 600 also includes a second attachment tab insertion zone 655 that is configured to engage with a second attachment tab (see, e.g., second attachment tab 650 of FIG. 6A) of another roofing material (or tile). According to an embodiment, the second attachment tab 650 is configured to engage with a second attachment tab insertion zone 655 of another roofing material (or tile) via an interlocking mechanism, such that no fasteners are needed for this connection.

As shown in the embodiment of FIG. 6B, which illustrates a back side or bottom view of the roofing material 600, the bottom surface 618 of the roofing material 600 includes a water channel cover 670, which is configured to interlock with and/or cover a water channel of another roofing material (not shown). According to one embodiment, this water channel cover 670 has a reduced side wall thickness to accommodate the second attachment tab 650. As shown in the embodiment of FIG. 6B, the bottom surface 618 of the roofing material 600 further includes (i) an alignment rib or ledge 655, which is configured to align the roofing material 600 with an underlying roofing material (not shown), and (ii) a first attachment tab (or anchor tab) interlock section 626, which is configured to engage with a first attachment (or anchor) tab of another roofing material (not shown). As also shown in the embodiment of FIG. 6B, the bottom surface 618 of the roofing material 600 includes engineered structural features or ribs support 660, which improve stress distribution and allow for easier manufacturability.

Figure 7A:
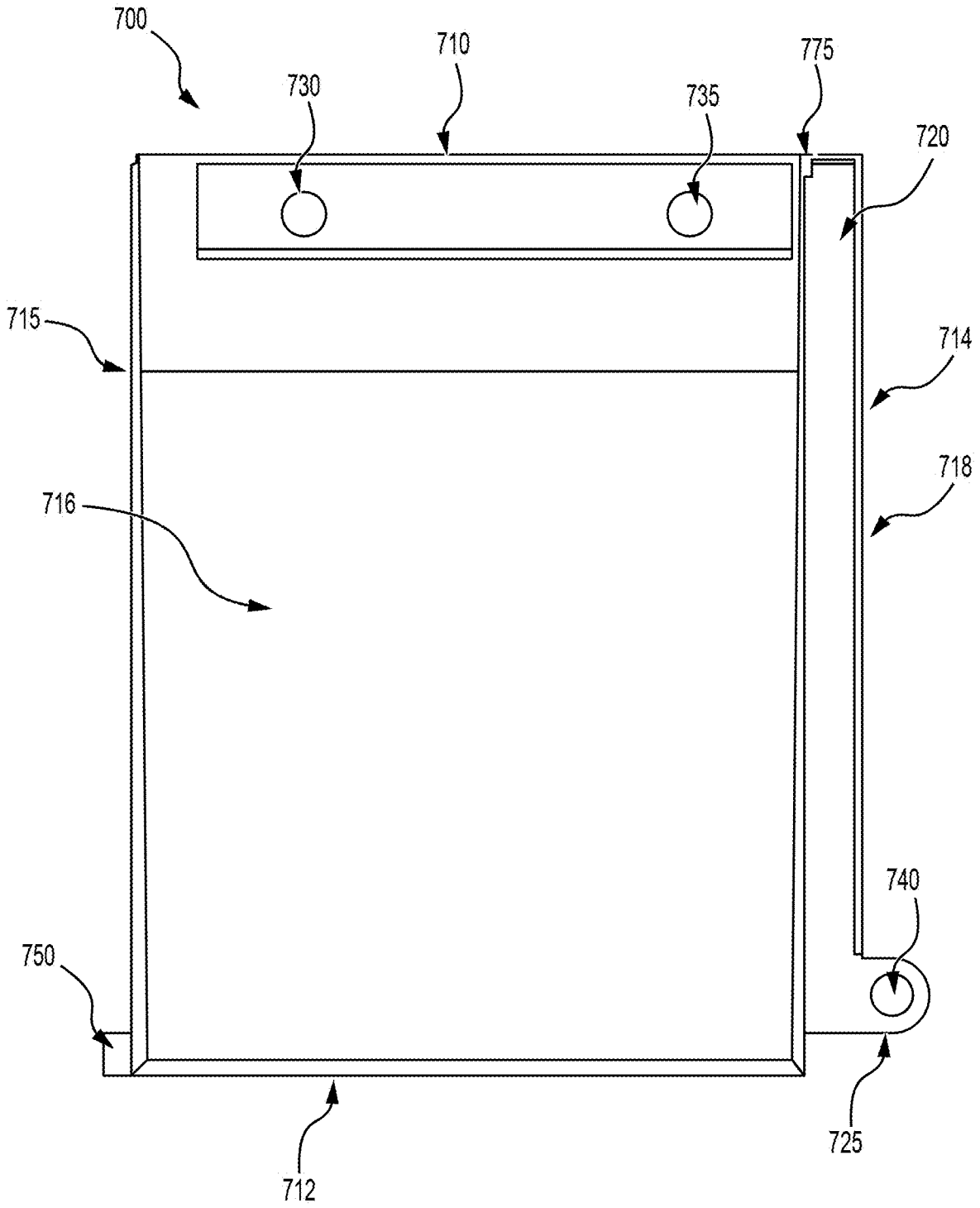
FIG. 7A illustrates a front or top side view of a roofing material having a water channel and a first and second attachment tab according to another embodiment of the invention.
Figure 7B:
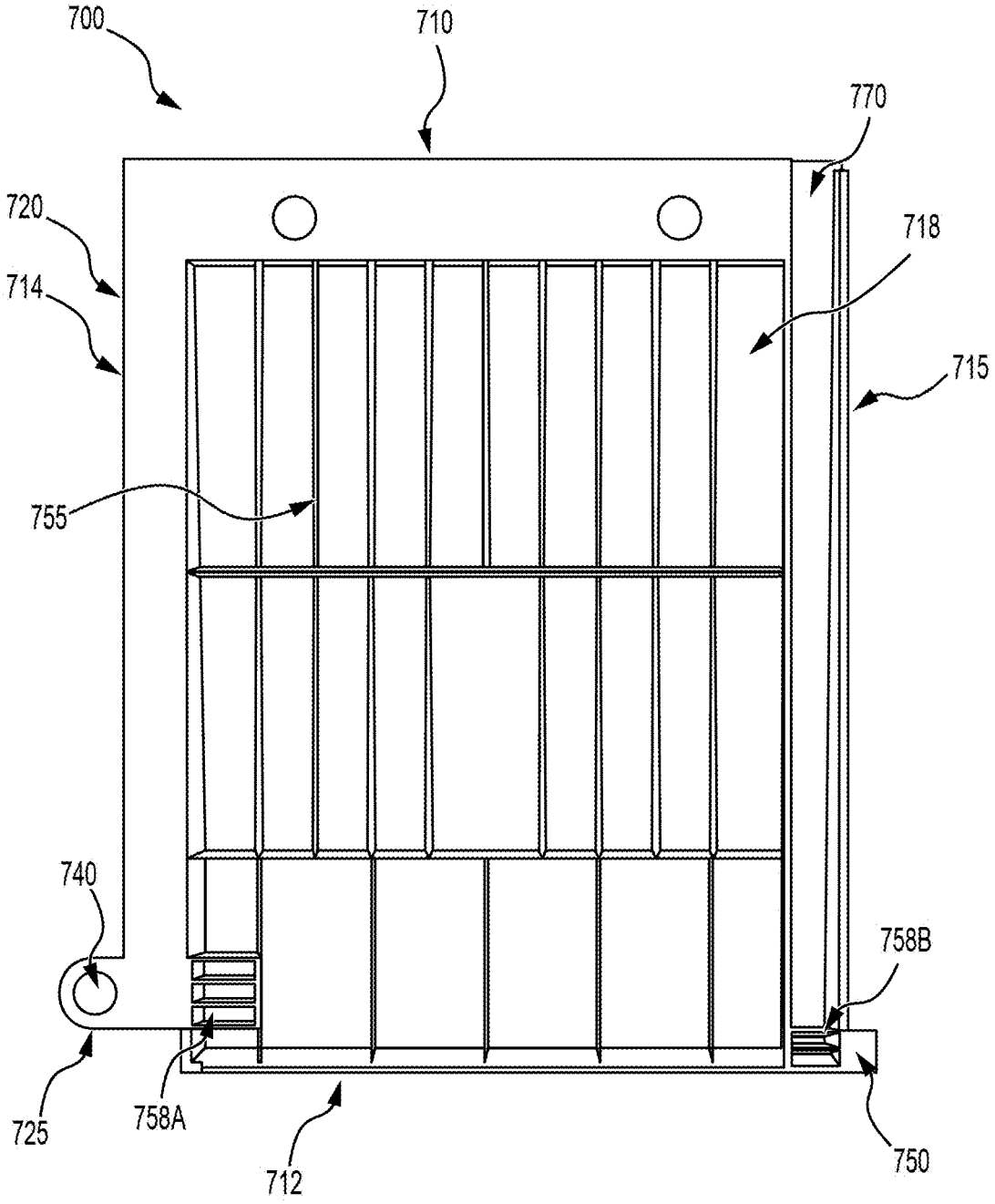
FIG. 7B illustrates a back or bottom side view of the roofing material of FIG. 7A having a water channel and a first and second attachment tab according to one embodiment of the invention.

FIGS. 7A and 7B illustrate another embodiment of a roofing material (e.g., roofing tile) according to an embodiment of the invention. According to this embodiment, a roofing tile 700 includes a top edge 710, a bottom edge 712 that is opposite to the top edge 710, a first side edge 714, and a second side edge 715 that is opposite to the first side edge 714. The roofing material 700 also includes a top surface 716 (see, e.g., FIG. 7A) and a bottom surface 718 (see, e.g., FIG. 7B). The roofing material 700 further includes (i) a water channel 720 that extends along the first side edge 714, from the top edge 710 to the bottom edge 712 of the roofing material 700, (ii) a first attachment tab 725 that is disposed on the first side edge 714 of the roofing material 700, and (iii) a second attachment tab 750 that is disposed on the second side edge 715 of the roofing material 700. As further shown in FIG. 7A, the roofing material 700 also includes a first attachment site 730 (or anchor location) and a second attachment site 735 (or anchor location) along the top edge 710 of the roofing material 700, with each of the first attachment site 730 and the second attachment site 735 being configured to engage with a fastener (not shown) (such as, e.g., a nail, screw, bolt, etc.) to attach the roofing material 700 to at least one of (i) a roofing substrate or (ii) another roofing material. The roofing material 700 also includes an attachment site 740 (or third attachment site or anchor location) on the first attachment tab 725, with the attachment site 740 (or third attachment site) being configured to engage with a fastener (not shown) (such as, e.g., a nail, screw, bolt, etc.) to attach the roofing material 700 to at least one of (i) a roofing substrate or (ii) another roofing material. As further shown in FIG. 7A, the roofing material 700 also includes a clearance setting feature 775 that allows for setting a constant and/or consistent tile-to-tile clearance, as well as easier installation.

As shown in the embodiment of FIG. 7B, which illustrates a back side or bottom view of the roofing material 700, the bottom surface 718 of the roofing material 700 includes a water channel cover 770, which is configured to interlock with and/or cover a water channel of another roofing material (not shown). According to one embodiment, this water channel cover 770 has a reduced side wall thickness to accommodate the second attachment tab 750. As shown in the embodiment of FIG. 7B, the bottom surface 718 of the roofing material 700 further includes a rib structure 755 that is designed for injection molding and provides support for walkability, as well as impact and deflection resistance. As also shown in the embodiment of FIG. 7B, the bottom surface 718 of the roofing material 700 further includes a plurality of tab supports 758A, 758B, with (i) a first set of tab supports 758A being provided with the first attachment tab 725 and (ii) a second set of tab supports 758B being provided with the second attachment tab 750. According to an embodiment, the plurality of tab supports 758A, 758B is configured to transfer loading and improve tab performance. According to one embodiment, the roofing material 700 of FIGS. 7A and 7B has a uniform thickness, which allows for uniform cooling for faster production, no curling, and a lighter weight roofing material (e.g., tile).

Yet another embodiment of this invention pertains to a roofing material comprising a top edge, a bottom edge that is opposite to the top edge, a first side edge, and a second side edge that is opposite to the first side edge. The roofing material further includes (i) a first water channel that extends along the first side edge, from the top edge to the bottom edge of the roofing material, (ii) a second water channel that extends along a middle portion of the roofing material, from the top edge to the bottom edge of the roofing material, and (iii) an attachment tab that is disposed on the first side edge.

Figure 11A:
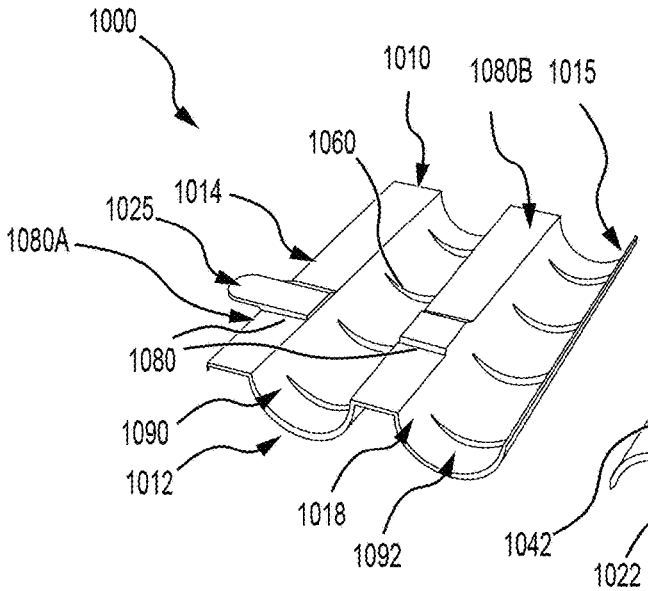
FIG. 11A illustrates a back or bottom side view of a roofing material with a barrel design having two water channels and an attachment tab according to one embodiment of the invention.
Figure 11B:
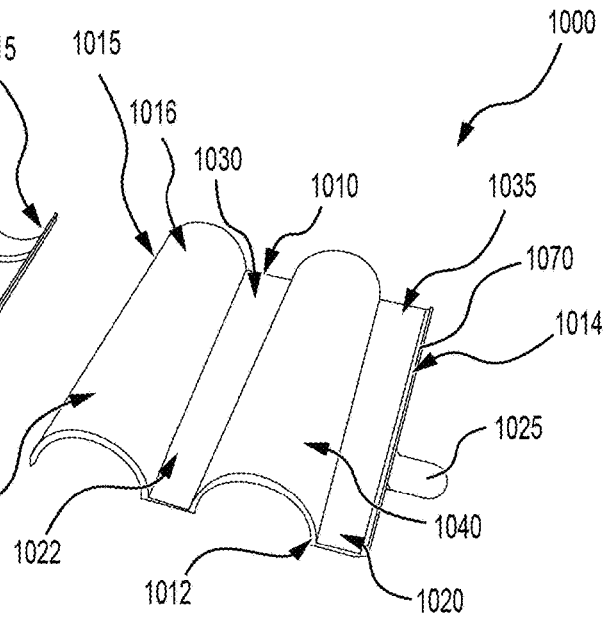
FIG. 11B illustrates a front or top side view of the roofing material of FIG. 11A having two water channels and an attachment tab according to one embodiment of the invention.

FIGS. 11A and 11B illustrate a roofing material 1000 (e.g., roofing tile) having a barrel design according to an embodiment of the invention. According to this embodiment, a roofing tile 1000 includes a top edge 1010, a bottom edge 1012 that is opposite to the top edge 1010, a first side edge 1014, and a second side edge 1015 that is opposite to the first side edge 1014. The roofing material 1000 also includes a top surface 1016 (see, e.g., FIG. 11B) and a bottom surface 1018 (see, e.g., FIG. 11A). The roofing material 1000 further includes (i) a first water channel 1020 that extends along the first side edge 1014, from the top edge 1010 to the bottom edge 1012 of the roofing material 1000, (ii) a second water channel 1022 that extends along a middle portion of the roofing material 1000, from the top edge 1010 to the bottom edge 1012 of the roofing material 1000, and (iii) an attachment tab (or anchor point) 1025 that is disposed on the first side edge 1014 of the roofing material 1000. As further shown in the embodiment of FIG. 11A, which illustrates a back side or bottom view of the roofing material 1000, the bottom surface 1018 of the roofing material 1000 includes a pair of alignment ledges 1080 that extends from the top edge 1010 to the bottom edge 1012 of the roofing material 1000 on the bottom surface 1018 of the roofing material 1000, with (i) a first alignment ledge 1080A of the pair of alignment ledges 1080 extending on a portion of the bottom surface 1018 of the roofing material 1000 that is opposite to the first water channel 1020, and (ii) a second alignment ledge 1080B of the pair of alignment ledges 1080 extending on a portion of the bottom surface 1018 of the roofing material 1000 that is opposite to the second water channel 1022. As also shown in the embodiment of FIG. 11A, the bottom surface 1018 of the roofing material 1000 includes a plurality of support ribs 1060, which improve stress distribution and allow for easier manufacturability.

As further shown in the embodiment of FIG. 11B, which illustrates a top side or top view of the roofing material 1000, the roofing material 1000 also includes a first attachment site 1030 (or anchor location) and a second attachment site 1035 (or anchor location) along the top edge 1010 of the roofing material 1000, with each of the first attachment site 1030 and the second attachment site 1035 being configured to engage with a fastener (not shown) (such as, e.g., a nail, screw, bolt, etc.) to attach the roofing material 1000 to at least one of (i) a roofing substrate or (ii) another roofing material.

In one embodiment, which is shown in FIG. 11B, the roofing material 1000 further includes a raised wall portion 1070 along the first water channel 1020 that extends from the top edge 1010 to the bottom edge 1012 of the roofing material 1000.

As further shown in the embodiment of FIGS. 11A and 11B, the roofing material 1000 also includes a first raised barrel portion 1040 that extends from the top edge 1010 to the bottom edge 1012 of the roofing material 1000 in an area between the first water channel 1020 and the second water channel 1022. The roofing material 1000 further includes a second raised barrel portion 1042 that extends from the top edge 1010 to the bottom edge 1012 of the roofing material 1000 in an area between the second water channel 1022 and the second side edge 1015 of the roofing material 1000. Additionally, as shown in the embodiment of FIGS. 11A and 11B, the roofing material 1000 also includes a pair of hollow portions 1090, 1092 that extends from the top edge 1010 to the bottom edge 1012 of the roofing material 1000 on the bottom surface 1018 of the roofing material 1000, with (i) a first hollow portion 1090 of the pair of hollow portions extending on a portion of the bottom surface 1018 of the roofing material 1000 that is opposite to the first raised barrel portion 1040, and (ii) a second hollow portion 1092 of the pair of hollow portions extending on a portion of the bottom surface 1018 of the roofing material 1000 that is opposite to the second raised barrel portion 1042.

In one embodiment, which is shown in FIG. 11A, each of the hollow portions 1090, 1092 of the pair of hollow portions includes a plurality of support ribs 1060 along a surface of the respective hollow portion 1090, 1092.

Figure 12:
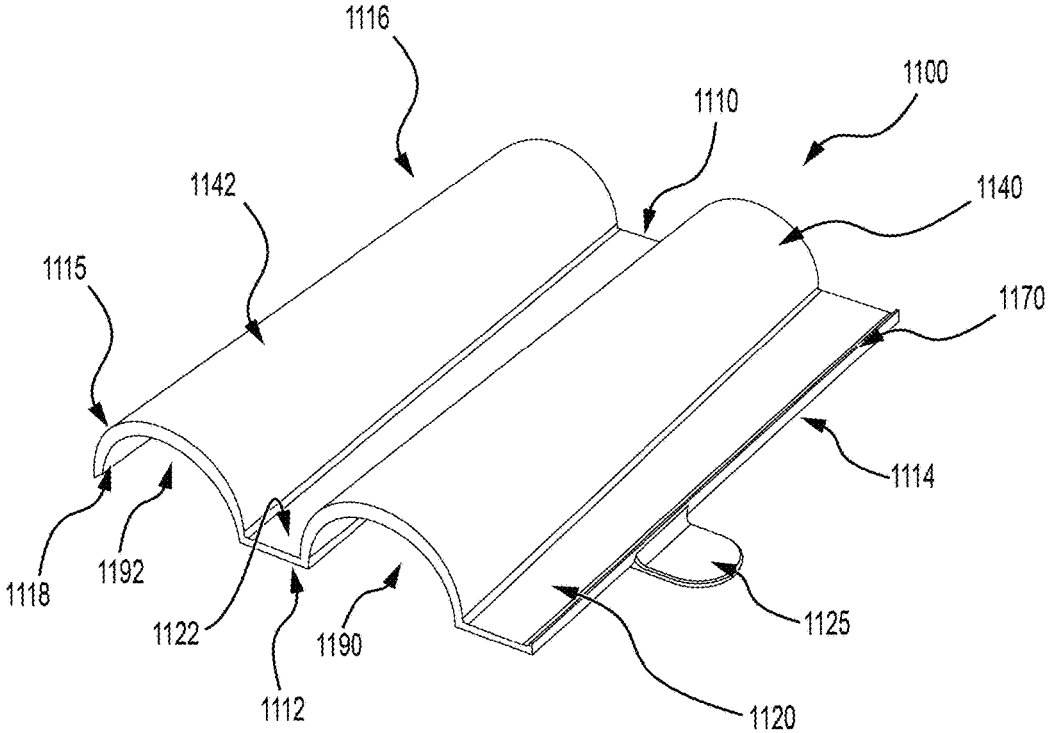
FIG. 12 is an illustration of a roofing material with a barrel design having two water channels and an attachment tab according to one embodiment of the invention.

FIG. 12 illustrates a roofing material 1100 (e.g., roofing tile) having a barrel design according to an embodiment of the invention. According to this embodiment, the roofing material 1100 includes a top edge 1110, a bottom edge 1112 that is opposite to the top edge 1110, a first side edge 1114, and a second side edge 1115 that is opposite to the first side edge 1114. The roofing material 1100 also includes a top surface 1116 and a bottom surface 1118. The roofing material 1100 further includes (i) a first water channel 1120 that extends along the first side edge 1114, from the top edge 1110 to the bottom edge 1112 of the roofing material 1100, (ii) a second water channel 1122 that extends along a middle portion of the roofing material 1100, from the top edge 1110 to the bottom edge 1112 of the roofing material 1100, and (iii) an attachment tab (or anchor point) 1125 that is disposed on the first side edge 1114 of the roofing material 1100.

As further shown in the embodiment of FIG. 12, the roofing material 1100 also includes a first raised barrel portion 1140 that extends from the top edge 1110 to the bottom edge 1112 of the roofing material 1100 in an area between the first water channel 1120 and the second water channel 1122. The roofing material 1100 further includes a second raised barrel portion 1142 that extends from the top edge 1110 to the bottom edge 1112 of the roofing material 1100 in an area between the second water channel 1122 and the second side edge 1115 of the roofing material 1100. Additionally, as shown in the embodiment of FIG. 12, the roofing material 1100 also includes a pair of hollow portions 1190, 1192 that extends from the top edge 1110 to the bottom edge 1112 of the roofing material 1100 on the bottom surface 1118 of the roofing material 1100, with (i) a first hollow portion 1190 of the pair of hollow portions extending on a portion of the bottom surface 1118 of the roofing material 1100 that is opposite to the first raised barrel portion 1140, and (ii) a second hollow portion 1192 of the pair of hollow portions extending on a portion of the bottom surface 1118 of the roofing material 1100 that is opposite to the second raised barrel portion 1142.

In one embodiment, which is shown in FIG. 12, the roofing material 1100 further includes a raised wall portion 1170 along the first water channel 1120 that extends from the top edge 1110 to the bottom edge 1112 of the roofing material 1100.

In one embodiment, which is shown in FIGS. 11B and 12, the attachment tab 1025, 1125 is disposed on the first side edge 1014, 1114 at a position that is adjacent to the bottom edge 1012, 1112 of the roofing material.

In one embodiment, which is shown in FIGS. 11B and 12, the attachment tab 1025, 1125 is disposed on the first side edge 1014, 1114 at a position that is along the first water channel 1020, 1120.

In one embodiment, the roofing material is a roofing tile. For example, according to one embodiment, the roofing tiles are made from any suitable material, including, but not limited to, clay, concrete, ceramics (including brick and fired clay), slate, and/or stone.

In one embodiment, the roofing material is a synthetic tile. For example, according to one embodiment, the synthetic tiles comprise a thermoplastic material, including, but not limited to, various thermoplastic polymers, elastomers, rubbers, copolymers, and/or polyolefins, as well as blends and filled formulations of thermoplastic materials, recycled materials, and combinations thereof. The synthetic tiles can further comprise fillers, such as, sand, calcium carbonate, stone dust, wood dust, etc. The synthetic tiles can also comprise functional additives, including, for example, fire retardants, colorants, pigments, stabilizers, impact modifiers, UV absorbers, anti-oxidizers, processing aids, and combinations thereof.

In one embodiment, the roofing material is configured to attach to a roofing substrate via one or more fasteners. In one embodiment, the roofing material is configured to attach to a roofing substrate via three fasteners. The fasteners may include, for example, nails, screws, staples, anchors, bolts, hardware, nuts, pins, studs, clips, rivets, rods, sockets, retaining rings, clamps, clasps, hangers, latches, pegs, washers, sealants, adhesives, etc., and combinations thereof.

In one embodiment, the water channel (see, e.g., water channel 120 of FIG. 1) is configured to channel water onto a top surface of an adjacent roofing material (see, e.g., FIG. 3, which is described in further detail below). In one embodiment, each of the first water channel and the second water channel (see, e.g., FIG. 13) is configured to channel water onto a top surface of an adjacent roofing material.

Another embodiment of this invention pertains to a roofing system comprising (a) a roofing substrate, (b) a first roofing material overlying the roofing substrate, the first roofing material having a top edge, a bottom edge that is opposite to the top edge, a first side edge, and a second side edge that is opposite to the first side edge, and (c) a second roofing material overlying the first roofing material, the second roofing material having a top edge, a bottom edge that is opposite to the top edge, a first side edge, and a second side edge that is opposite to the first side edge. Each of the first roofing material and the second roofing material further includes (i) a water channel that extends along the first side edge of the respective roofing material, from the top edge to the bottom edge of the respective roofing material, and (ii) an attachment tab that is disposed on the first side edge of the respective roofing material.

Figure 3:
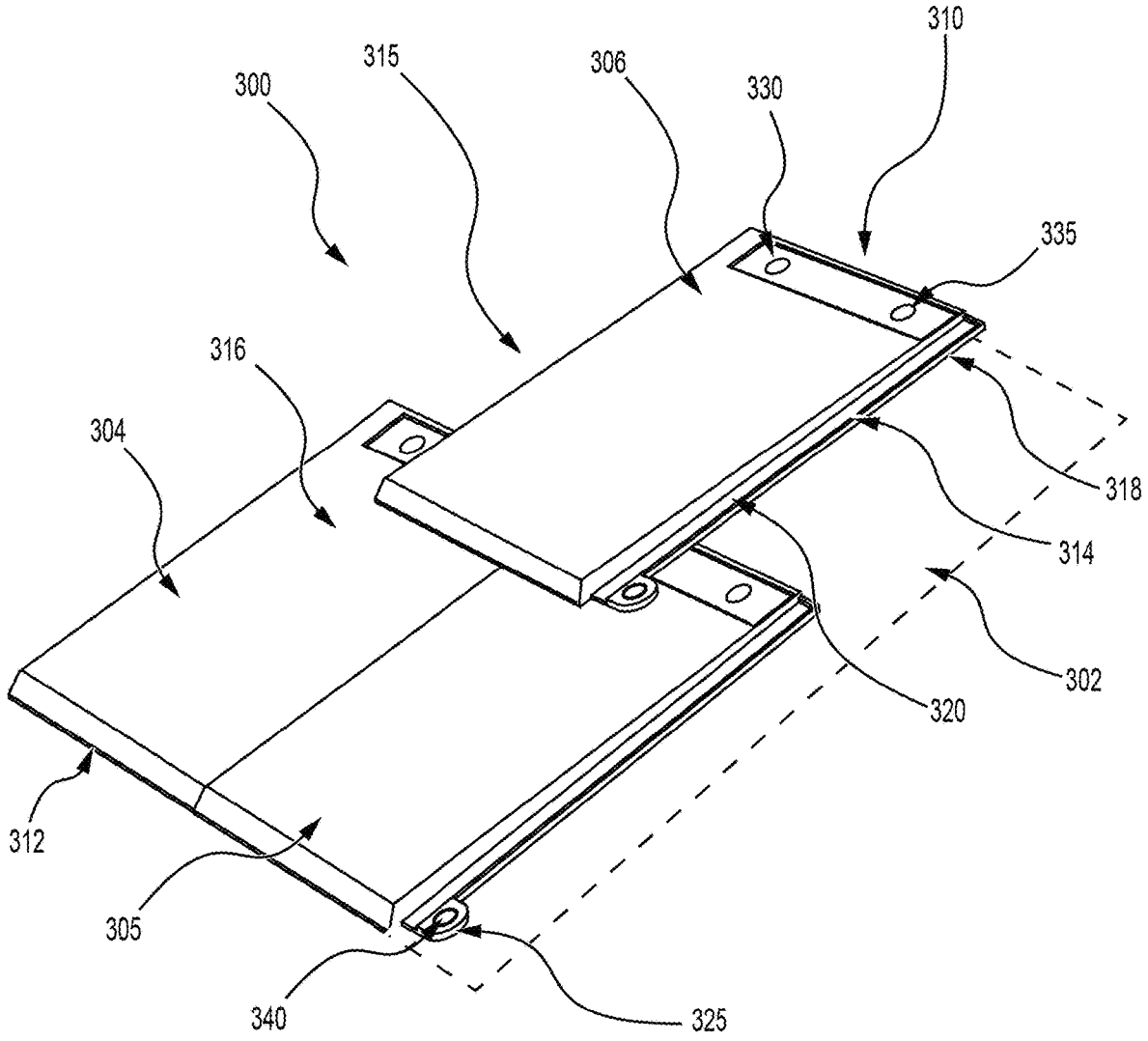
FIG. 3 is an illustration of a roofing system that includes at least three roofing materials, with each of the roofing materials having a water channel and an attachment tab according to one embodiment of the invention.

FIG. 3 illustrates a roofing system 300 according to an embodiment of the invention. According to this embodiment, the roofing system 300 includes a roofing substrate 302, a first roofing material 304 overlying the roofing substrate 302, a second roofing material 305 overlying the roofing substrate 302, and a third roofing material 306 overlying the first roofing material 304, the second roofing material 305, and the roofing substrate 302. As shown in the embodiment of FIG. 3, each of the first roofing material 304, the second roofing material 305, and the third roofing material 306 have a top edge 310, a bottom edge 312 that is opposite to the top edge 310, a first side edge 314, and a second side edge 315 that is opposite to the first side edge 314. Each of the first roofing material 304, the second roofing material 305, and the third roofing material 306 further includes (i) a water channel 320 that extends along the first side edge 314 of the respective roofing material, from the top edge 310 to the bottom edge 312 of the respective roofing material, and (ii) an attachment tab 325 that is disposed on the first side edge 314 of the respective roofing material.

As further shown in FIG. 3, each of the first roofing material 304, the second roofing material 305, and the third roofing material 306 also includes a first attachment site 330 and a second attachment site 335 along the top edge 310 of the respective roofing material, with each of the first attachment site 330 and the second attachment site 335 being configured to engage with a fastener (not shown) (such as, e.g., a nail, screw, bolt, etc.) to attach the respective roofing material to at least one of (i) the roofing substrate 302 or (ii) another roofing material. Each of the first roofing material 304, the second roofing material 305, and the third roofing material 306 also includes an attachment site 340 (or third attachment site) on the attachment tab 325, with the attachment site 340 (or third attachment site) being configured to engage with a fastener (not shown) (such as, e.g., a nail, screw, bolt, etc.) to attach the respective roofing material to at least one of (i) the roofing substrate 302 or (ii) another roofing material.

In one embodiment, the water channel (see, e.g., water channel 320) is configured to channel water onto a top surface of an adjacent roofing material. For example, as shown in the embodiment of FIG. 3, the water channel 320 of the third roofing material 306 is configured to channel water onto the top surface 316 of the second roofing material 305.

Another embodiment of this invention pertains to a roofing system comprising (a) a roofing substrate, (b) a first roofing material overlying the roofing substrate, the first roofing material having a top edge, a bottom edge that is opposite to the top edge, a first side edge, and a second side edge that is opposite to the first side edge, and (c) a second roofing material overlying the first roofing material, the second roofing material having a top edge, a bottom edge that is opposite to the top edge, a first side edge, and a second side edge that is opposite to the first side edge. Each of the first roofing material and the second roofing material further includes (i) a water channel that extends along the first side edge, from the top edge to the bottom edge of the roofing material, (ii) a first attachment tab that is disposed on the first side edge, and (iii) a second attachment tab that is disposed on the second side edge. (See, e.g., roofing materials illustrated in FIGS. 5, 6A, 6B, 7A and 7B.)

In one embodiment, the water channel of at least one of the first roofing material and the second roofing material is configured to channel water onto a top surface of an adjacent roofing material.

In one embodiment, the water channel of the second roofing material is configured to channel water onto a top surface of the first roofing material.

Figure 13:
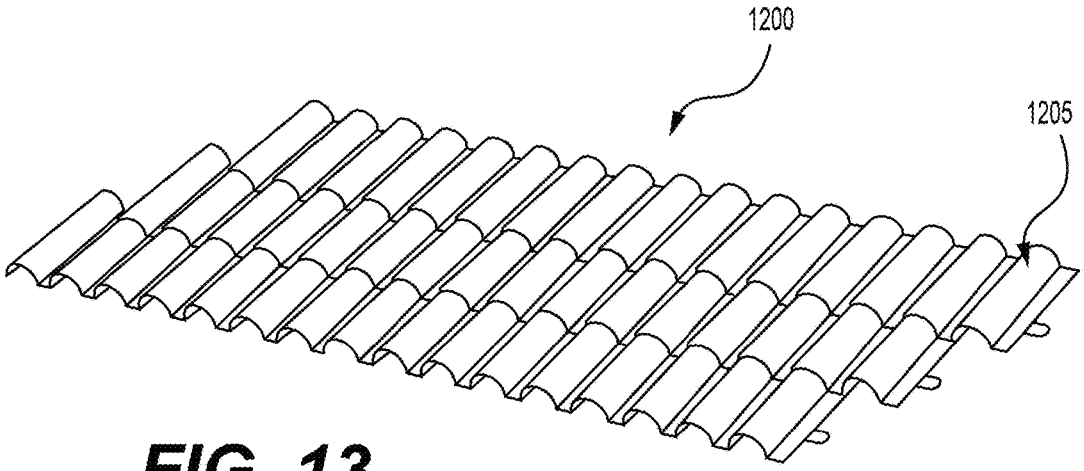
FIG. 13 is an illustration of a roofing system having a plurality of overlapping roofing materials, with each of the roofing materials having a barrel design with two water channels and an attachment tab according to one embodiment of the invention.

Another embodiment of this invention pertains to a roofing system comprising (a) a roofing substrate, (b) a first roofing material overlying the roofing substrate, the first roofing material having a top edge, a bottom edge that is opposite to the top edge, a first side edge, and a second side edge that is opposite to the first side edge, and (c) a second roofing material overlying the first roofing material, the second roofing material having a top edge, a bottom edge that is opposite to the top edge, a first side edge, and a second side edge that is opposite to the first side edge. Each of the first roofing material and the second roofing material further includes (i) a first water channel that extends along the first side edge, from the top edge to the bottom edge of the roofing material, (ii) a second water channel that extends along a middle portion of the roofing material, from the top edge to the bottom edge of the roofing material, and (iii) an attachment tab that is disposed on the first side edge. For example, as shown in FIG. 13, a roofing system 1200 is illustrated that comprises a plurality of roofing materials 1205, with each of the roofing materials including (i) a first water channel that extends along the first side edge, from the top edge to the bottom edge of the roofing material, (ii) a second water channel that extends along a middle portion of the roofing material, from the top edge to the bottom edge of the roofing material, and (iii) an attachment tab that is disposed on the first side edge. (See, e.g., roofing materials illustrated in FIGS. 11A, 11B, and 12.)

In one embodiment, each of the first water channel and the second water channel of at least one of the first roofing material and the second roofing material is configured to channel water onto a top surface of an adjacent roofing material.

In one embodiment, each of the first water channel and the second water channel of the second roofing material is configured to channel water onto a top surface of the first roofing material.

In some embodiments, the first roofing material, the second roofing material and/or the third roofing material are interlocking tiles.

In one embodiment, the roofing substrate comprises a roof deck substrate, a roof deck substrate to which one or more underlayment material layers have been attached, or a combination thereof.

In one embodiment, each of the first roofing material, the second roofing material and/or the third roofing material is attached to the roofing substrate via one or more fasteners. In one embodiment, each of the first roofing material, the second roofing material and/or the third roofing material is attached to the roofing substrate via three fasteners. In one embodiment, each of the first roofing material, the second roofing material and/or the third roofing material is attached to the roofing substrate via four fasteners.

Another embodiment of this invention pertains to a method of installing roofing materials onto a roofing substrate. The method comprises obtaining a first roofing material having a top edge, a bottom edge that is opposite to the top edge, a first side edge, and a second side edge that is opposite to the first side edge, obtaining a second roofing material having a top edge, a bottom edge that is opposite to the top edge, a first side edge, and a second side edge that is opposite to the first side edge, and installing the first and second roofing materials to the roofing substrate, such that the second roofing material overlays at least a portion of the first roofing material. Each of the first roofing material and the second roofing material further includes (i) a water channel that extends along the first side edge of the respective roofing material, from the top edge to the bottom edge of the respective roofing material, and (ii) an attachment tab that is disposed on the first side edge of the respective roofing material. (See, e.g., FIG. 3, as discussed above).

Yet another embodiment of this invention pertains to a method of installing roofing materials onto a roofing substrate. The method comprises obtaining a first roofing material having a top edge, a bottom edge that is opposite to the top edge, a first side edge, and a second side edge that is opposite to the first side edge, obtaining a second roofing material having a top edge, a bottom edge that is opposite to the top edge, a first side edge, and a second side edge that is opposite to the first side edge, and installing the first and second roofing materials to the roofing substrate, such that the second roofing material overlays at least a portion of the first roofing material. Each of the first roofing material and the second roofing material further includes (i) a water channel that extends along the first side edge, from the top edge to the bottom edge of the respective roofing material, (ii) a first attachment tab that is disposed on the first side edge of the respective roofing material, and (iii) a second attachment tab that is disposed on the second side edge of the respective roofing material.

Another embodiment of this invention pertains to a method of installing roofing materials onto a roofing substrate. The method comprises obtaining a first roofing material having a top edge, a bottom edge that is opposite to the top edge, a first side edge, and a second side edge that is opposite to the first side edge, obtaining a second roofing material having a top edge, a bottom edge that is opposite to the top edge, a first side edge, and a second side edge that is opposite to the first side edge, and installing the first and second roofing materials to the roofing substrate, such that the second roofing material overlays at least a portion of the first roofing material. Each of the first roofing material and the second roofing material further includes (i) a first water channel that extends along the first side edge, from the top edge to the bottom edge of the respective roofing material, (ii) a second water channel that extends along a middle portion of the respective roofing material, from the top edge to the bottom edge of the roofing material, and (iii) an attachment tab that is disposed on the first side edge of the respective roofing material. (See, e.g., FIG. 13, as discussed above).

In one embodiment, the method further comprises attaching the first roofing material and the second roofing material to the roofing substrate via fasteners. In one embodiment, the method further comprises attaching the first roofing material and the second roofing material to the roofing substrate via three fasteners. In one embodiment, the method further comprises attaching the first roofing material and the second roofing material to the roofing substrate via four fasteners.

In one embodiment, the roofing material includes three attachment points to attach the roofing material to at least one of (i) a roofing substrate or (ii) another roofing material. In an embodiment, the roofing material exhibits an increased wind uplift resistance as compared to a roofing material without three attachment points. In an embodiment, the roofing material exhibits an increased wind uplift resistance as compared to a roofing material with only two attachment points.

In one embodiment, the roofing material includes four attachment points to attach the roofing material to at least one of (i) a roofing substrate or (ii) another roofing material. In an embodiment, the roofing material exhibits an increased wind uplift resistance as compared to a roofing material without four attachment points. In an embodiment, the roofing material exhibits an increased wind uplift resistance as compared to a roofing material with only two attachment points.

Figure 4A:
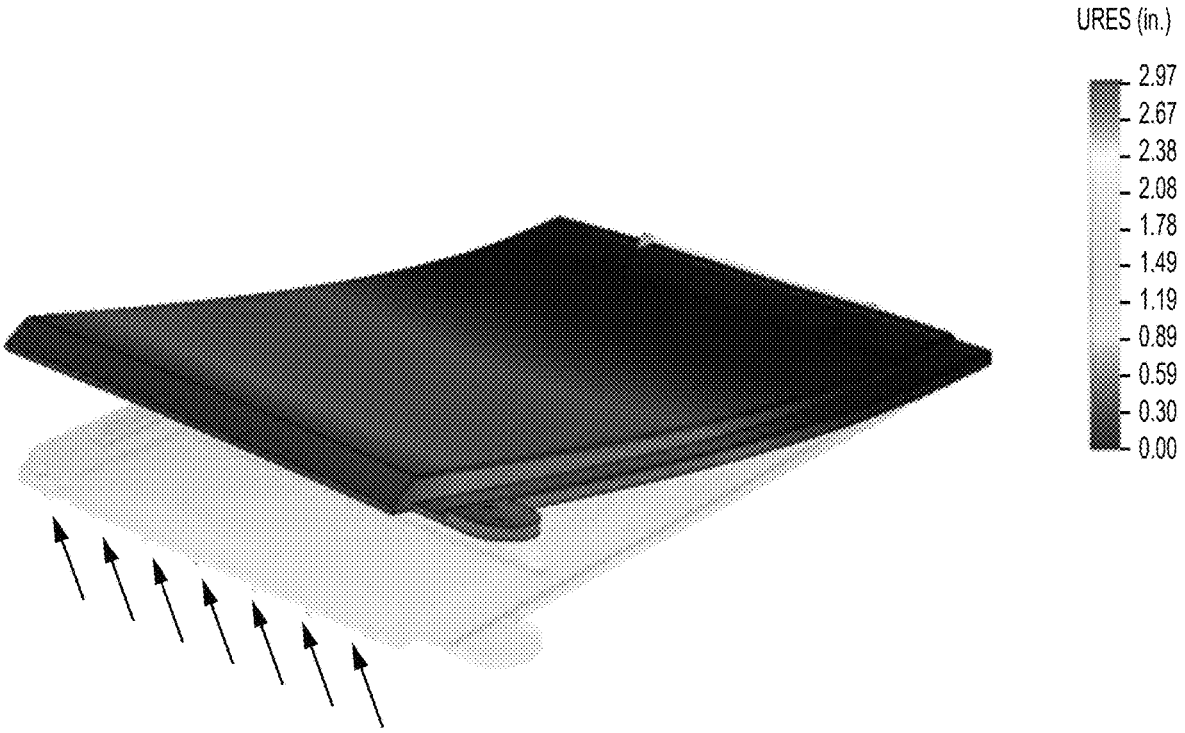
FIGS. 4A-4D are images of a finite element analysis that illustrates the uplift resistance and stress response of a first roofing material having three attachment points as compared to a second roofing material having only two attachment points according to one embodiment of the invention.
Figure 4B:
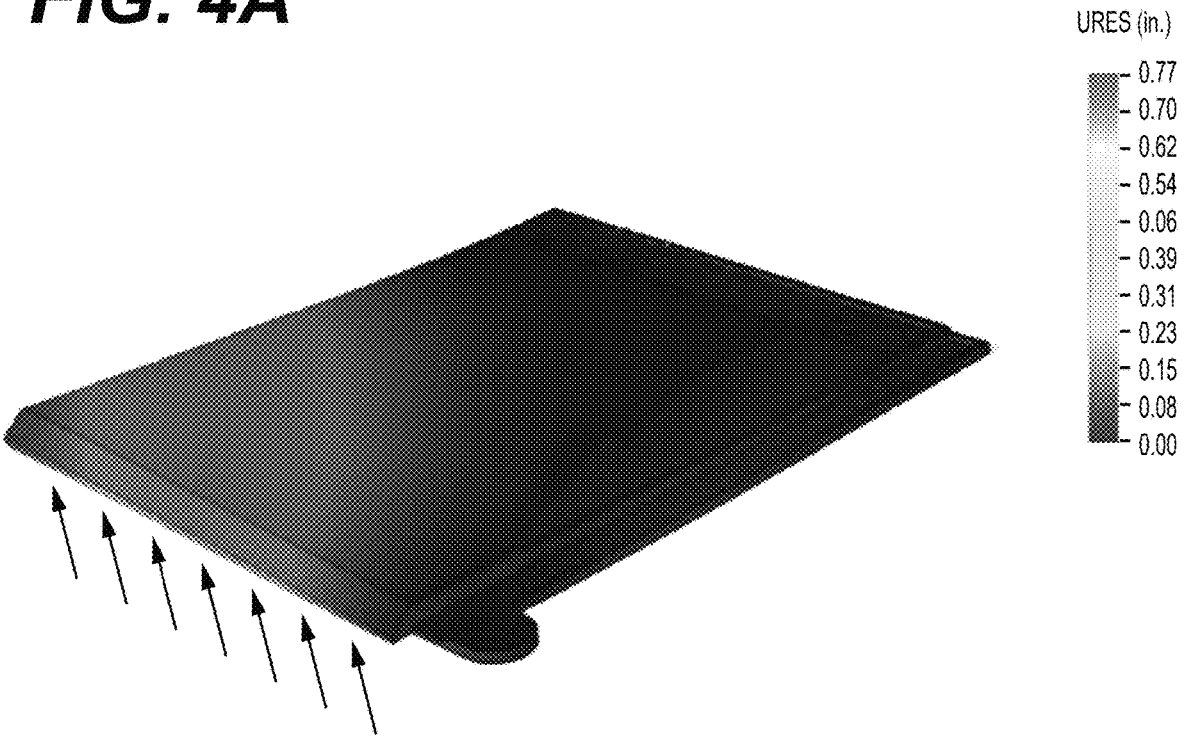

According to one embodiment, as shown in the images of FIGS. 4A-4D, a finite element analysis is provided that illustrates the uplift resistance and stress response of a first roofing material having three attachment points as compared to a second roofing material having only two attachment points according to one embodiment of the invention. For example, FIG. 4A illustrates an exemplary roofing tile that is attached to a surface by only two attachments points along the top edge of the roofing tile, while FIG. 4B illustrates an exemplary roofing tile that is attached to a surface by the two attachments points along the top edge of the roofing tile and is also attached via the attachment point on the attachment tab near the bottom edge of the roofing tile. As shown, when comparing FIG. 4A to 4B, the tile deflection is much greater for the roofing tile illustrated in FIG. 4A with the two attachment points as compared to the roofing tile illustrated in FIG. 4B with the three attachment points. In this regard, the tile deflection comparison between the two versus three attachment points is in response to an external load that is equivalent to three-times the tile weight being applied at the bottom edge of the tile pulling upwards. Thus, the finite element analysis (FEA) simulation, as illustrated in FIGS. 4A and 4B, indicates a 74% deflection reduction by the introduction of the third attachment point on the attachment tab of the roofing tile. Accordingly, the third attachment point (as illustrated in FIG. 4B) provides improved wind uplift resistance.

Figure 4C:
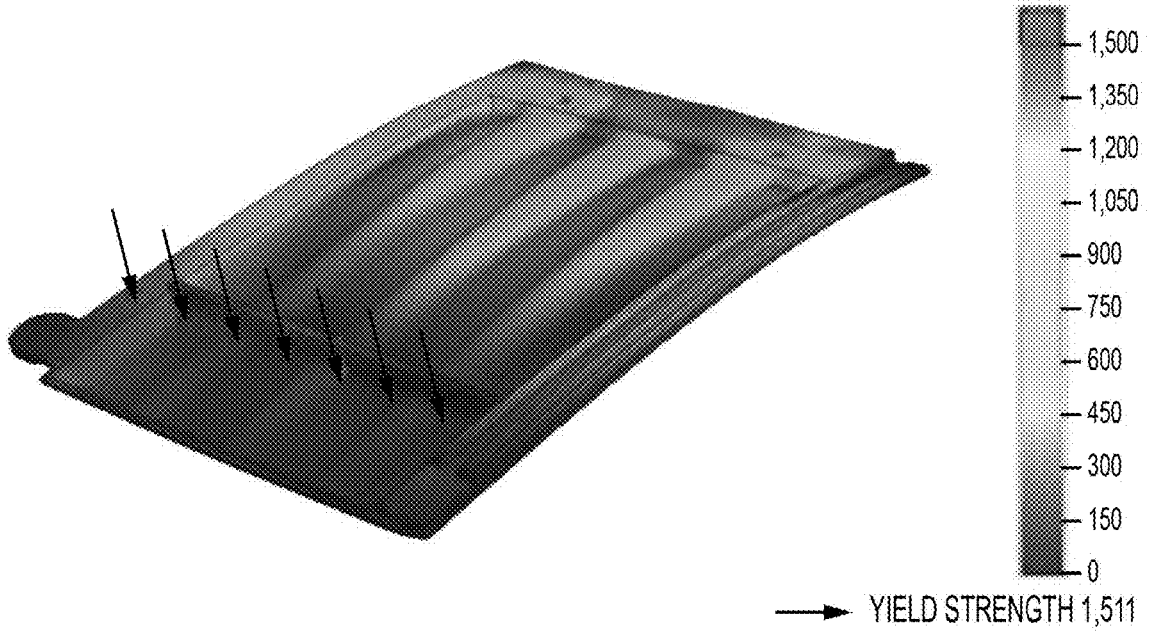
Figure 4D:
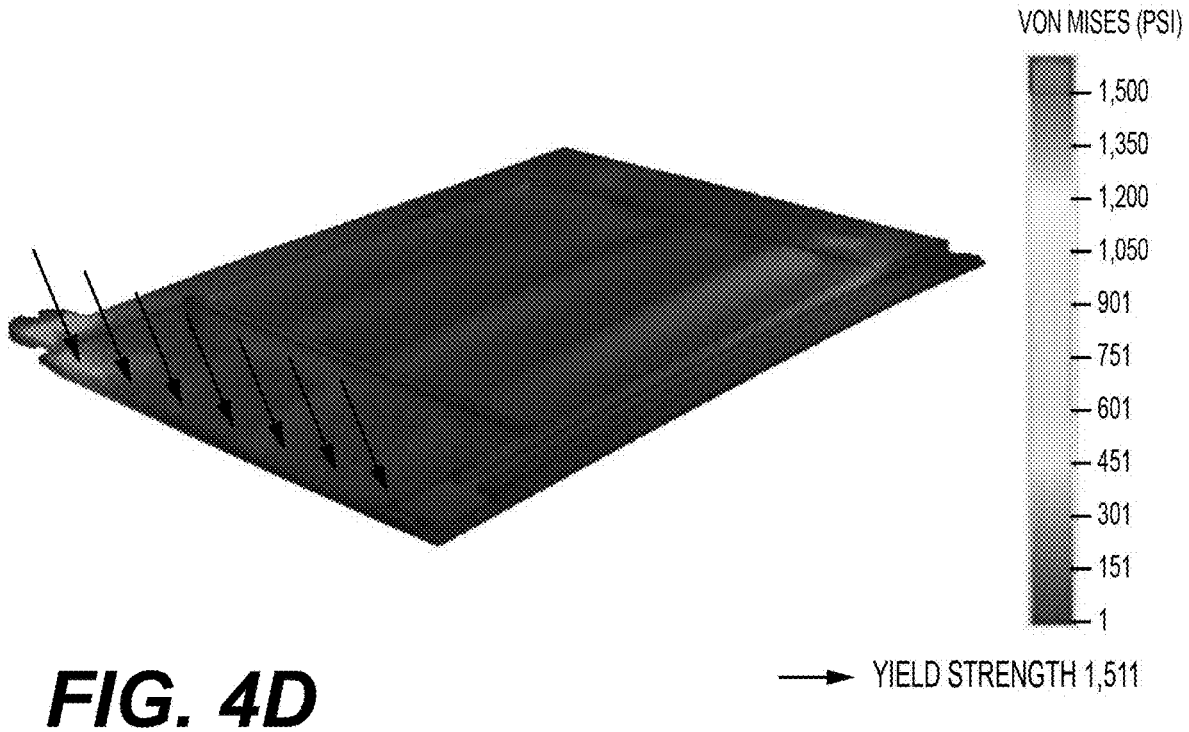

FIGS. 4C and 4D illustrate a finite element analysis that compares a stress response of a roofing tile having only two attachment points as compared to a roofing tile having three attachment points. For example, FIG. 4C illustrates an exemplary roofing tile that is attached to a surface by only two attachments points along the top edge of the roofing tile, while FIG. 4D illustrates an exemplary roofing tile that is attached to a surface by the two attachments points along the top edge of the roofing tile and is also attached via the attachment point on the attachment tab near the bottom edge of the roofing tile. As shown, when comparing FIG. 4C to 4D, the stress response is much greater for the roofing tile illustrated in FIG. 4C with the two attachment points as compared to the roofing tile illustrated in FIG. 4D with the three attachment points. In this regard, the stress response comparison between the two versus three attachment points on deflected tiles is due to an external load that is equivalent to three-times the tile weight being applied at the bottom edge of the tile pulling upwards. Thus, the finite element analysis (FEA) simulation, as illustrated in FIGS. 4C and 4D, calculates a local stress drop of greater than 70% by the introduction of the third attachment point on the attachment tab of the roofing tile, which brings the maximum local stress to below the yield point. Accordingly, the third attachment point (as illustrated in FIG. 4D) provides an improved stress response.

Figure 8A:
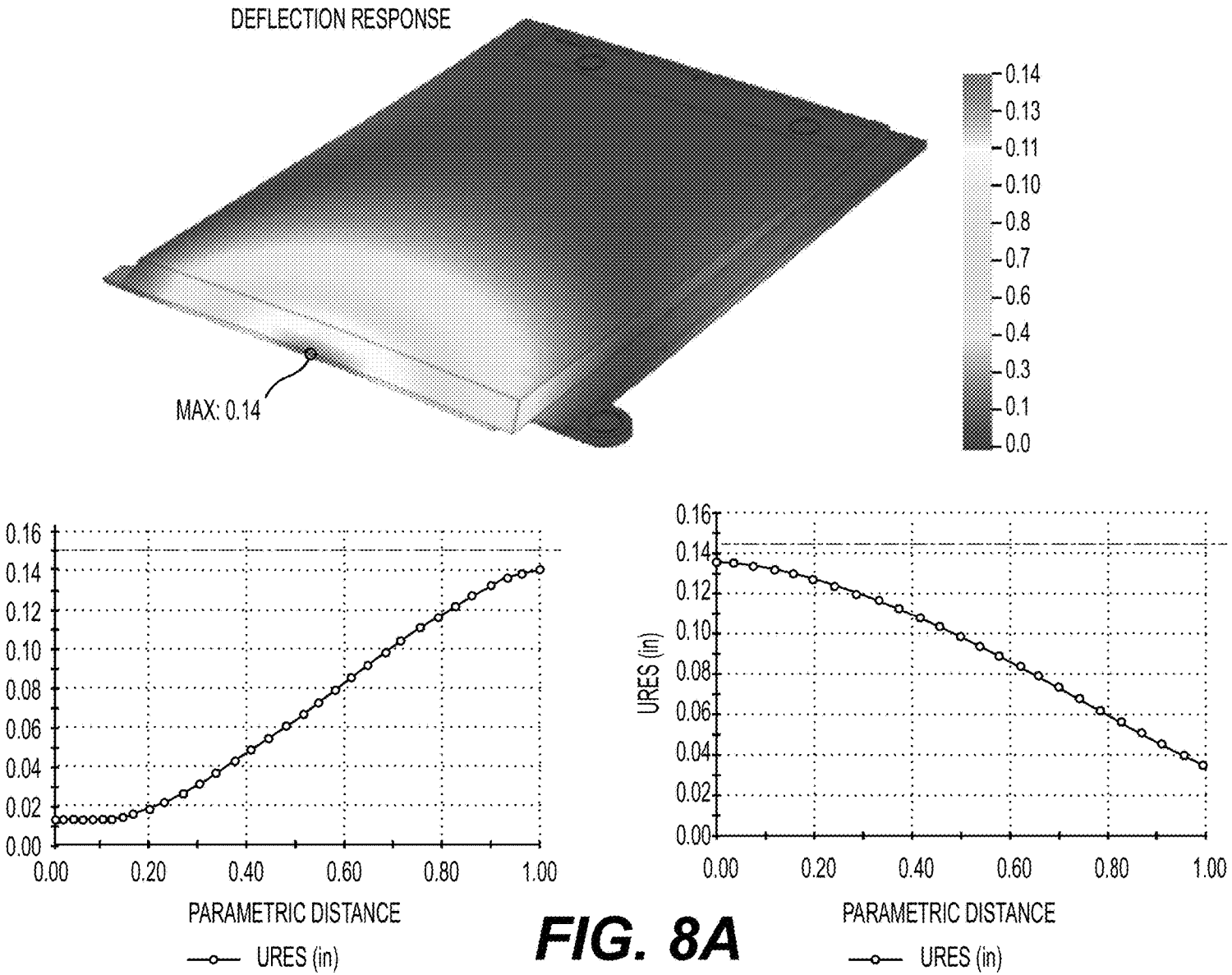
FIGS. 8A and 8B are images of a finite element analysis that illustrates the uplift resistance via the deflection response and stress response of a roofing material having four attachment points according to one embodiment of the invention.
Figure 8B:
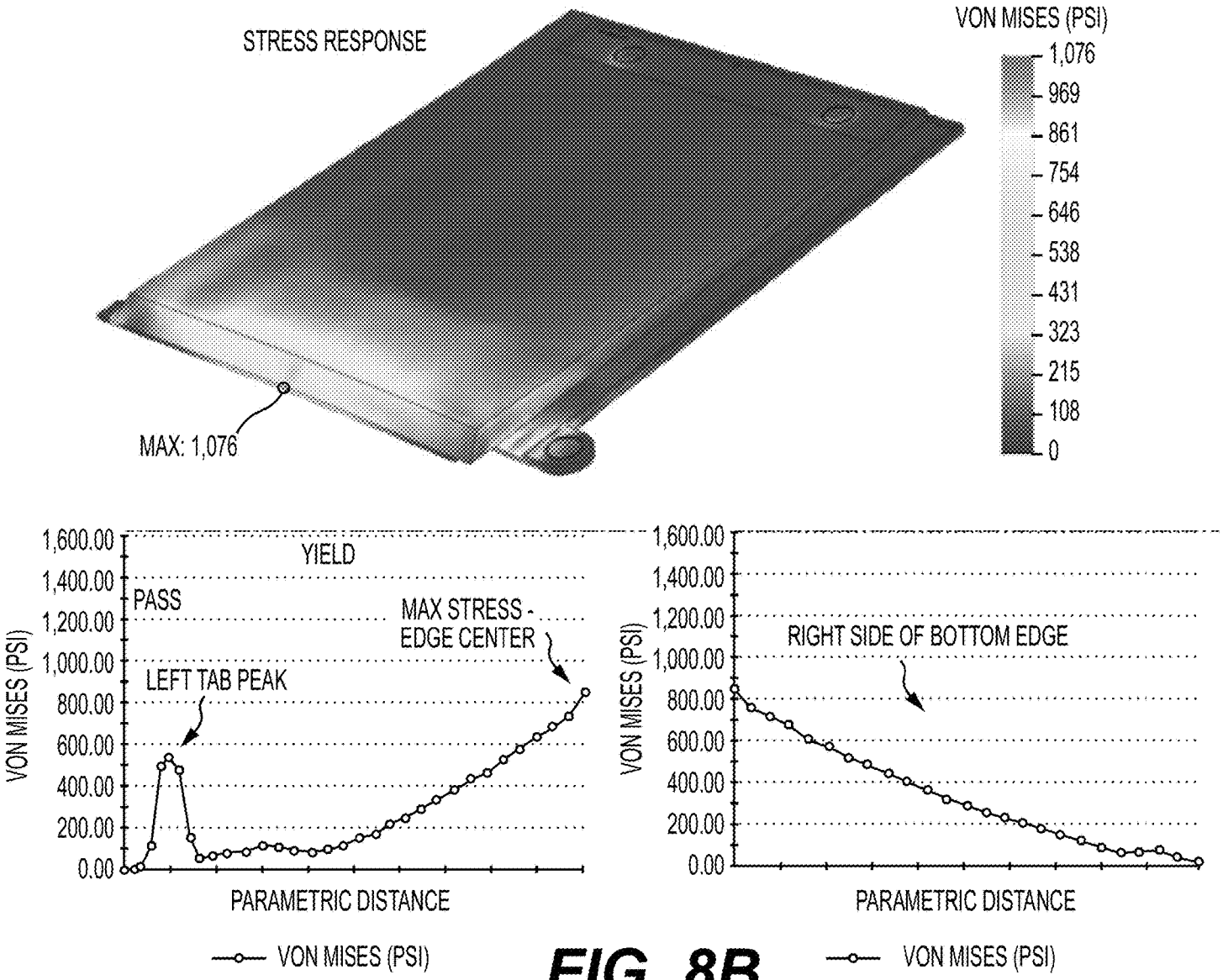

According to one embodiment, as shown in the images of FIGS. 8A and 8B, a finite element analysis is provided that illustrates the uplift resistance via the deflection response and stress response of a roofing material having four attachment points according to one embodiment of the invention. For example, FIGS. 8A and 8B illustrate an exemplary roofing tile that is attached to a surface by two attachments points along the top edge of the roofing tile and is also attached via (i) an attachment point on a first attachment tab along the first side edge of the roofing tile near the bottom edge of the roofing tile, and (ii) a second attachment tab along the second side edge of the roofing tile near the bottom edge of the roofing tile. (See, e.g., roofing materials of FIGS. 5, 6A, and 6B.) According to the embodiment of FIGS. 8A and 8B, the deflection response (FIG. 8A) and the stress response (FIG. 8B) illustrate no failure when two-times (2×) the tile weight is pulling an upward load along the bottom edge of the roofing tile.

Figure 9A:
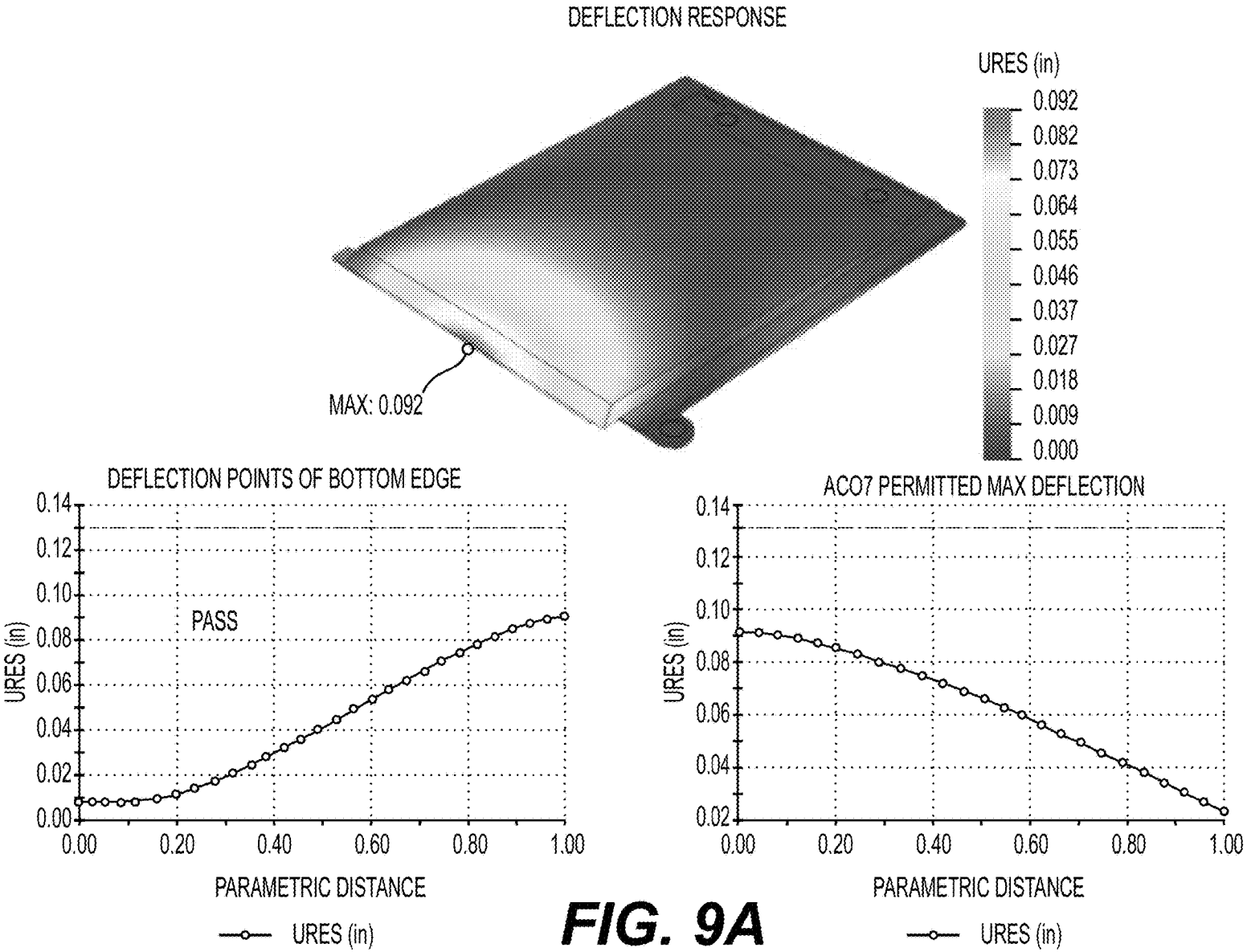
FIGS. 9A and 9B are images of a finite element analysis that illustrates the uplift resistance via deflection response and stress response of a roofing material having four attachment points according to one embodiment of the invention.
Figure 9B:
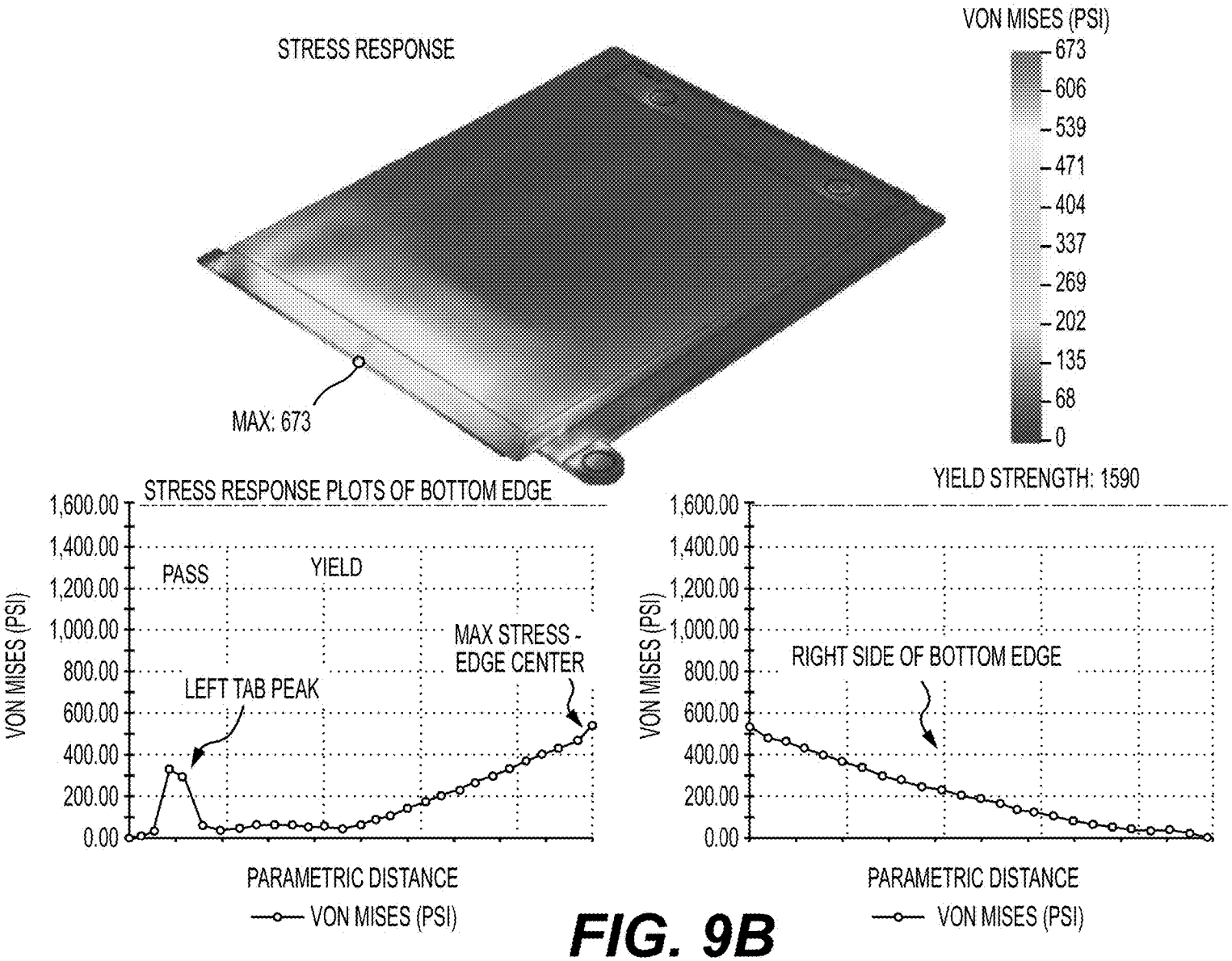

According to one embodiment, as shown in the images of FIGS. 9A and 9B, a finite element analysis is provided that illustrates the uplift resistance via the deflection response and stress response of a roofing material having four attachment points according to one embodiment of the invention. For example, FIGS. 9A and 9B illustrate an exemplary roofing tile that is attached to a surface by two attachments points along the top edge of the roofing tile and is also attached via (i) an attachment point on a first attachment tab along the first side edge of the roofing tile near the bottom edge of the roofing tile, and (ii) a second attachment tab along the second side edge of the roofing tile near the bottom edge of the roofing tile. (See, e.g., roofing materials of FIGS.

5, 6A, and 6B.) According to the embodiment of FIGS. 9A and 9B, the deflection response (FIG. 9A) and the stress response (FIG. 9B) illustrate no failure when two-times (2×) the tile weight is pulling an upward load along the bottom edge of the roofing tile. According to this embodiment, as shown in FIGS. 9A and 9B, the maximum localized stress response is less than the yield stress.

Figure 10A:
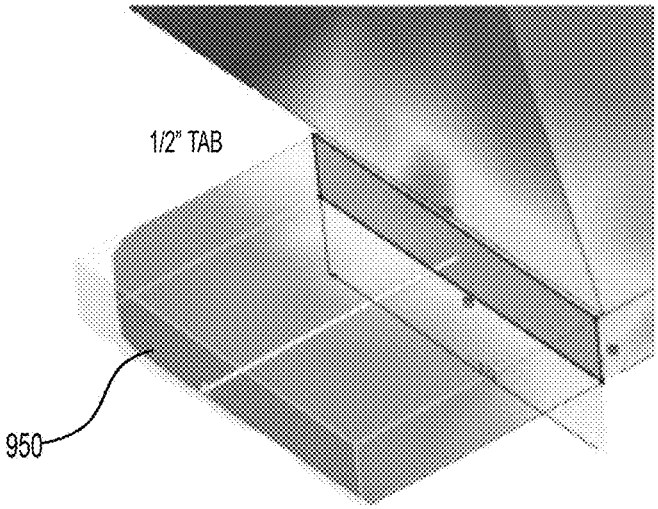
FIGS. 10A and 10B are images of a finite element analysis that illustrates the stress response of an attachment tab that is decreased in size according to one embodiment of the invention.
Figure 10B:
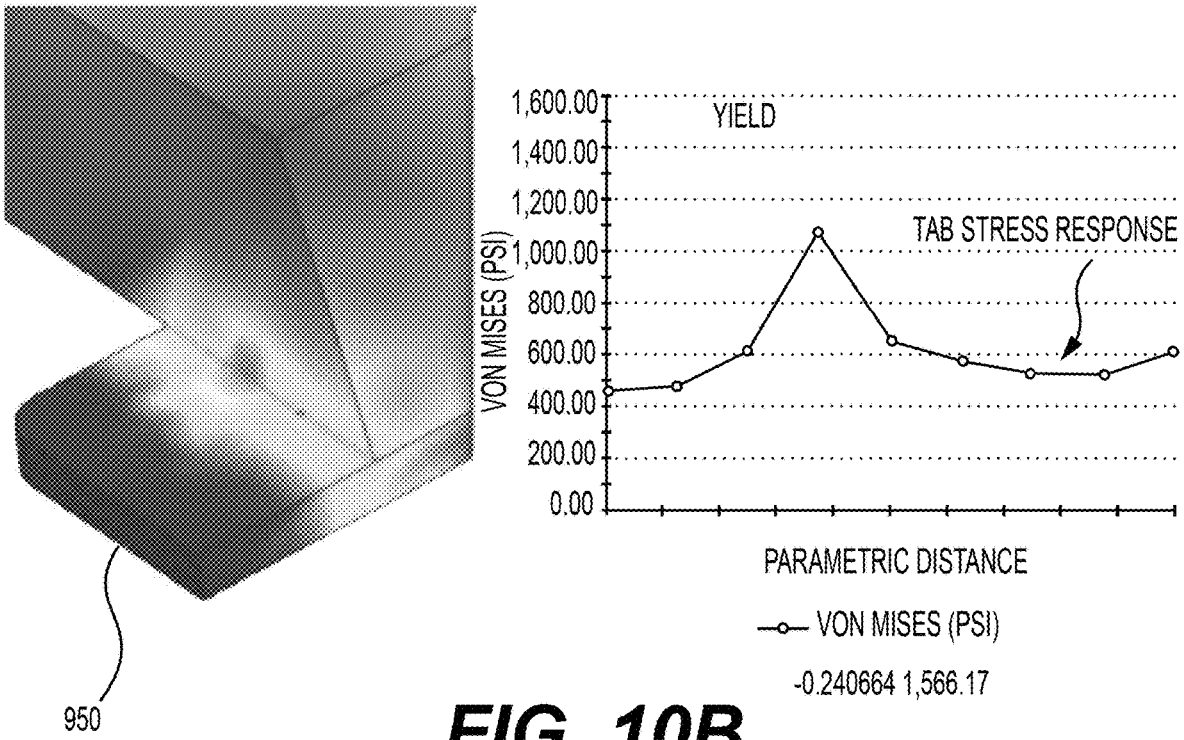

According to one embodiment, as shown in the images of FIGS. 10A and 10B, a finite element analysis is provided that illustrates the stress response of an attachment tab that is decreased in size according to one embodiment of the invention. For example, as shown in FIG. 10A, a second attachment tab 950 that is added to a roofing tile is decreased in size by 20%. However, as illustrated in FIG. 10B, this decrease in size of the second attachment tab 950 still results in a stress response that is below yield.

Figures 14A, 14B:
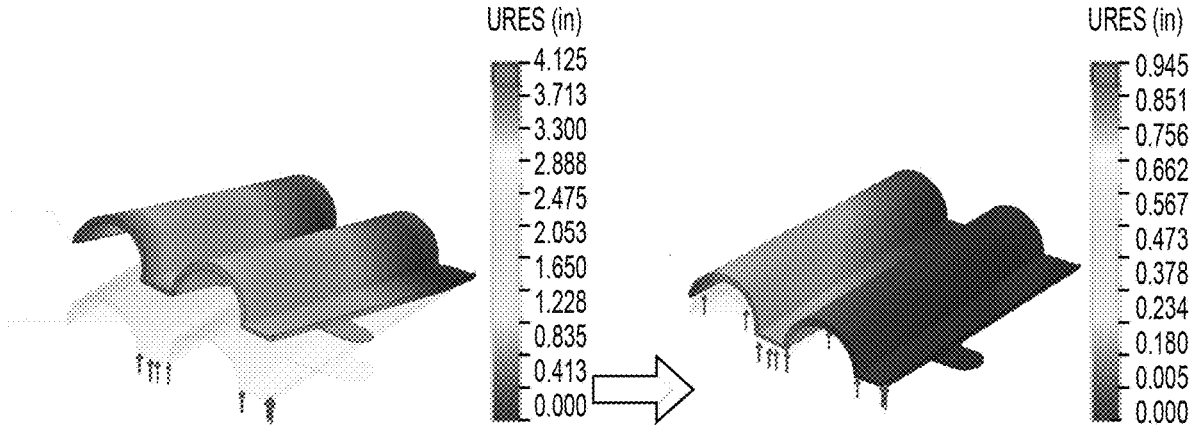
FIGS. 14A and 14B are images of a finite element analysis that illustrates the deflection response of a first roofing material having a barrel design and three attachment points as compared to a second roofing material having a barrel design and only two attachment points according to one embodiment of the invention.

According to one embodiment, as shown in the images of FIGS. 14A and 14B, a finite element analysis is provided that illustrates the uplift resistance and deflection response of a first roofing material having three attachment points as compared to a second roofing material having only two attachment points according to one embodiment of the invention. For example, FIG. 14A illustrates an exemplary roofing tile having a barrel design (see, e.g., FIG. 12) that is attached to a surface by only two attachments points along the top edge of the roofing tile, while FIG. 11B illustrates an exemplary roofing tile having a barrel design that is attached to a surface by the two attachments points along the top edge of the roofing tile and is also attached via the attachment point on the attachment tab near the bottom edge of the roofing tile. As shown, when comparing FIG. 14A to 14B, the tile deflection is much greater for the roofing tile illustrated in FIG. 14A with the two attachment points as compared to the roofing tile illustrated in FIG. 14B with the three attachment points. In this regard, the tile deflection comparison between the two versus three attachment points is in response to an external load that is equivalent to three-times the tile weight being applied at the bottom edge of the tile pulling upwards. Thus, the finite element analysis (FEA) simulation, as illustrated in FIGS. 14A and 14B, indicates a 77% reduction in deflection in response to the same external load by the introduction of the third attachment point on the attachment tab of the roofing tile. Accordingly, the third attachment point (as illustrated in FIG. 14B) provides improved wind uplift resistance.

According to an embodiment, a roofing material (e.g., a roofing tile) is provided having a water channel and an attachment tab along the same side edge (e.g., right hand side) of the roofing material, which allows for improved (or increased) wind uplift resistance or performance, along with an ease of installation. For example, by including two attachment points along the top edge of the roofing material and a third attachment point along a side edge (or attachment tab) of the roofing material, which is near the bottom edge of the roofing material and on the same side edge as a water channel, all three points of attachment can be fastened or attached prior to a next tile (in a course) being installed. This improvement in the installation of the roofing material can provide over 2 to 3 hours of time savings for the entire roof tile installation by securing the tile at all three points of attachment prior to installing the next tile, which is an improvement over more complex and time-consuming installation of roofing materials (e.g., roofing tiles) that include an attachment tab on the opposite (vertical) side from an interlocking water channel element and require the two attachment points along a top edge of the roofing tile to be secured first, a second roofing tile to be interlocked with the first roofing tile, and the final, third attachment point to thereafter be secured or fastened.

According to an embodiment, a roofing material (e.g., a roofing tile) is provided to enhance wind uplift performance (via the bottom right anchoring tab and the bottom left interlocking tab) and ease of installation (by allowing all three nail attachment points to be installed prior to the positioning and attachment of the next tile in the course). Additionally, adding a fourth restraining point will address thermal deformation of tiles in the field. The second attachment tab (or fourth left-hand side restraining tab) will mechanically interlock with the adjacent tile body and first attachment tab (or third attachment point). The second attachment tab (or fourth interlocking tab) on the bottom left side will be restrained through the means of a mechanical interlock instead of a mechanical fastener.

According to an embodiment, the inclusion of a bottom-side anchor and interlock tabs dramatically improves wind uplift and minimizes deflection due to bending forces. According to some embodiments, a roofing tile is provided that allows for the tile to be secured at all four corners, which will enhance its wind uplift performance, and improve the tile's geometrical stability and extend its service life. Synthetic tiles tend to curl up with time due to the heat load being applied on the top surface of the roof coverings leading to non-uniform thermal expansion and contraction. However, this issue can be prevented with proposed designs herein.

According to some embodiments described herein, implementing a fourth interlocking and restraining point on a roofing tile makes it more difficult for the tile to bend during a wind event. Furthermore, the additional interlocking tab on the bottom left corner will serve as a restraining point to prevent the roof covering from curling up due to thermal loading and/or upward pulling forces. This additional anchor point will also help with aligning the tiles during installation and make it easier to fit.

According to embodiments described herein, a unique barrel tile design is provided that includes a third anchor point for enhanced (or improved) uplift performance and stability on the roof. The proposed design offers water channels, a raised interlocking section, and a nail-able third tab, which will serve as an alignment ledge, removing the need for chalk lines, thus allowing for quicker and simpler installation. According to one embodiment, all fasteners will be hidden by the adjacent tiles. According to an embodiment, the tile will be light weight and will be much easier to cut and install on a roof. No roof reinforcement is needed to install the proposed tile compared to concrete or clay tiles, which weigh significantly more and require roof reinforcement.

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

The invention claimed is:

1. A roofing material comprising:

a top edge;

a bottom edge that is opposite to the top edge;

a first side edge;

a second side edge that is opposite to the first side edge;

a water channel that extends along the first side edge, from the top edge to the bottom edge of the roofing material; and a first attachment tab that is disposed on the first side edge at a position that is adjacent to and offset from the bottom edge of the roofing material; and a second attachment tab that is disposed on the second side edge at a position that is adjacent to and colinear with the bottom edge of the roofing material and opposite to the first attachment tab disposed on the first side edge.

2. The roofing material according to claim 1, wherein the first attachment tab is further disposed on the first side edge at a position that is along the water channel.

3. The roofing material according to claim 1, wherein the roofing material includes at least two attachment sites along the top edge of the roofing material, such that each attachment site of the at least two attachment sites is configured to engage with a fastener to attach the roofing material to at least one of (i) a roofing substrate or (ii) another roofing material.

4. The roofing material according to claim 1, wherein the roofing material includes an attachment site on the first attachment tab, such that the attachment site on the first attachment tab is configured to engage with a fastener to attach the roofing material to at least one of (i) a roofing substrate or (ii) another roofing material.

5. The roofing material according to claim 1, wherein the roofing material is a roofing tile.

6. The roofing material according to claim 1, wherein the roofing material includes at least three attachment points to attach the roofing material to at least one of (i) a roofing substrate or (ii) another roofing material.

7. A roofing material comprising:

a top edge;

a bottom edge that is opposite to the top edge;

a first side edge;

a second side edge that is opposite to the first side edge;

a water channel that extends along the first side edge, from the top edge to the bottom edge of the roofing material;

a first attachment tab that is disposed on the first side edge at a position that is adjacent to and offset from the bottom edge of the roofing material; and a second attachment tab that is disposed on the second side edge at a position that is adjacent to and colinear with the bottom edge of the roofing material.

8. The roofing material according to claim 7, wherein the first attachment tab is further disposed on the first side edge at a position that is along the water channel.

9. The roofing material according to claim 7, wherein the second attachment tab is further disposed on the second side edge at a position that is opposite to the first attachment tab disposed on the first side edge.

10. The roofing material according to claim 7, wherein the roofing material includes at least two attachment sites along the top edge of the roofing material, such that each attachment site of the at least two attachment sites is configured to engage with a fastener to attach the roofing material to at least one of (i) a roofing substrate or (ii) another roofing material.

11. The roofing material according to claim 7, wherein the roofing material includes an attachment site on the first attachment tab, such that the attachment site on the first attachment tab is configured to engage with a fastener to attach the roofing material to at least one of (i) a roofing substrate or (ii) another roofing material.

12. The roofing material according to claim 7, wherein the roofing material includes four attachment points to attach the roofing material to at least one of (i) a roofing substrate or (ii) another roofing material.

13. A roofing system comprising:

(a) a roofing substrate;

(b) a first roofing material overlying the roofing substrate, the first roofing material having a top edge, a bottom edge that is opposite to the top edge, a first side edge, and a second side edge that is opposite to the first side edge; and (c) a second roofing material overlying the first roofing material, the second roofing material having a top edge, a bottom edge that is opposite to the top edge, a first side edge, and a second side edge that is opposite to the first side edge, wherein each of the first roofing material and the second roofing material further includes (i) a water channel that extends along the first side edge of the respective roofing material, from the top edge to the bottom edge of the respective roofing material, and (ii) a first attachment tab that is disposed on the first side edge of the respective roofing material at a position that is adjacent to and offset from the bottom edge of the respective roofing material, and (iii) a second attachment tab that is disposed on the second side edge of the respective roofing material at a position that is adjacent to and colinear with the bottom edge of the respective roofing material and opposite to the first attachment tab disposed on the first side edge of the respective roofing material.

14. The roofing system according to claim 13, wherein the first attachment tab is further disposed on the first side edge of the respective roofing material at a position that is along the water channel of the respective roofing material.

15. The roofing system according to claim 13, wherein the water channel of the second roofing material is configured to channel water onto a top surface of the first roofing material.

16. The roofing system according to claim 13, wherein the roofing substrate comprises a roof deck substrate, a roof deck substrate to which one or more underlayment material layers have been attached, or a combination thereof.

* * * * *